United States Patent [19]

Sato et al.

[11] Patent Number: 4,910,126

[45] Date of Patent: Mar. 20, 1990

[54] LIGHT-SENSITIVE SILVER HALIDE COLOR PHOTOGRAPHIC MATERIAL

[75] Inventors: Hirokazu Sato, Hino; Shigeto Hirabayashi, Hachioji, both of Japan

[73] Assignee: Konica Corporation, Tokyo, Japan

[21] Appl. No.: 178,969

[22] Filed: Apr. 7, 1988

[30] Foreign Application Priority Data

Apr. 10, 1987 [JP] Japan ..... 62-88105

[51] Int. Cl.[4] ..... G03C 1/08; G03C 1/10; G03C 7/38

[52] U.S. Cl. ..... 430/546; 430/551; 430/558; 430/601; 430/610

[58] Field of Search ..... 430/551, 601, 610, 558, 430/546

[56]. References Cited

U.S. PATENT DOCUMENTS

| | | | |
|---|---|---|---|
| 4,072,525 | 2/1978 | Inouye et al. | 430/558 |
| 4,353,979 | 10/1982 | Terada et al. | 430/546 |
| 4,639,413 | 1/1987 | Kawagishi et al. | 430/546 |
| 4,659,652 | 4/1987 | Kawagishi | 430/548 |
| 4,755,455 | 7/1988 | Iwasa | 430/558 |
| 4,762,773 | 8/1988 | Takahashi et al. | 430/558 |
| 4,770,987 | 9/1988 | Takahashi et al. | 430/546 |

FOREIGN PATENT DOCUMENTS

| | | | |
|---|---|---|---|
| 0056833 | 8/1979 | Japan | 430/551 |
| 1073152 | 4/1986 | Japan | 430/551 |
| 2079452 | 4/1987 | Japan | 430/558 |
| 2172357 | 7/1987 | Japan | 430/558 |
| 2180366 | 8/1987 | Japan | 430/558 |
| 2180367 | 8/1987 | Japan | 430/558 |
| 2058382 | 4/1981 | United Kingdom . | |

*Primary Examiner*—Paul R. Michl
*Assistant Examiner*—Lee C. Wright
*Attorney, Agent, or Firm*—Finnegan, Henderson, Farabow, Garrett and Dunner

[57] ABSTRACT

A light-sensitive silver halide photographic material comprising a support and provided thereon a silver halide emulsion layer containing a magenta dye-forming coupler represented by formula (M-I) and a compound represented by formula (I):

(M-1)

wherein Z represents a group of non-metal atoms necessary to complete a nitrogen-containing heterocylic ring which may have a substituent; X represents a hydrogen atom or a substituent capable of being split off upon reaction with the oxidized product of a color developing agent; and R represents a hydrogen atom or a substituent;

(I)

wherein $R^1$, $R^2$ and $R^3$ independently represent an aliphatic group or an aromatic group; and l, m, n independently represent 0 to 1 provided that l, m and n are not 1 at the same time is disclosed.

14 Claims, 1 Drawing Sheet

LIGHT-SENSITIVE SILVER HALIDE COLOR PHOTOGRAPHIC MATERIAL

FIELD OF THE INVENTION

The present invention relates to a light-sensitive silver halide photographic material having good spectral absorption characteristics and superior color reproducibility of the dye formed, and moreover having superior image storage stability and capable of attaining higher maximum density.

BACKGROUND OF THE INVENTION

In color photographic paper used for direct viewing, usually used is the combination of a yellow coupler, a magenta coupler and a cyan coupler. Among these, recently developed as the magenta coupler are pyrazoloazole type couplers.

The pyrazoloazole type couplers, being different from 5-pyrazolone type magenta couplers conventionally used, are characterized by being fundamentally advantageous to the color reproducibility because the dye formed therefrom has no side absorption around 430 nm. They, however, generally have a longer maximum absorption wavelength as compared with the 5-pyrazolone type magenta couplers, and therefore disadvantageous in that the absorption at the longer side of 600 nm or more is not sharply reduced to zero.

The magenta couplers obtained from the pyrazoloazole type magenta couplers are also known to have image storage instability, in particular, light-resistance that is inferior to the magenta coupler obtained from the 5-pyrazolone type magenta couplers, raising a great problem when they are put into practical use. Still also, the pyrazoloazole type magenta couplers have color-forming properties inferior to the 5-pyrazolone type magenta couplers, resulting in a lower maximum density of the magenta dye images to be obtained, disadvantageously.

As stated above, in actual state of things, there have not been discovered any light-sensitive silver halide photographic materials having excellent properties for all of the color reproducibility, image storage stability and color-forming properties of the magenta dye images.

SUMMARY OF THE INVENTION

A first object of the present invention is to provide a light-sensitive silver halide photographic material that can form, using the pyrazoloazole type magenta coupler, a magenta dye image having such an excellent hue that the absorption at the long wavelength side may be sharply reduced to zero, and that have been improved in the color reproducibility.

A second object of the present invention is to provide a light-sensitive silver halide photographic material having superior storage stability of the magenta dye image.

A third object of the present invention is provide a light-sensitive silver halide photographic material that can have a high color-forming density and obtain a sufficient maximum density.

Thus the present invention specifically relates to a light-sensitive silver halide photographic material comprising a support and provided thereon a silver halide emulsion layer containing a magenta-forming coupler represented by Formula (M-I) and a compound represented by Formula (I);

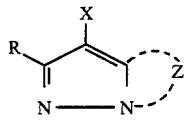

(M-1)

wherein Z represents a group of non-metal atoms necessary to complete a nitrogen-containing heterocyclic ring which may have a substituent; X represents a hydrogen atom or a substituent capable of being split off upon reaction with the oxidized product of a color developing agent; and R represents a hydrogen atom or a substituent;

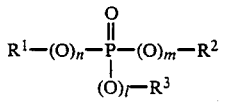

(I)

wherein $R^1$, $R^2$ and $R^3$ independently represent an aliphatic group or an aromatic group; and 1, m and n independently represent 0 or 1 provided that 1, m and n each are not 1 at the same time.

DETAILED DESCRIPTION OF THE INVENTION

In the magenta coupler represented by Formula (M-I):

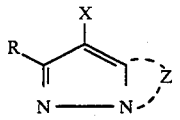

according to the present invention, Z represents a group of non-metal atoms necessary for the formation of a nitrogen-containing heterocyclic ring, and the ring formed by said Z may have a substituent.

X represents a hydrogen atom or a group capable of being split off through reaction with an oxidized product of a color developing agent.

And, R represents a hydrogen atom or a substituent.

There is no particular limitation in the substituent represented by R, but it may typically include groups of alkyl, aryl, anilino, acylamino, sulfonamide, alkylthio, arylthio, alkenyl, cycloalkyl, etc. Besides these, also included are halogen atoms, groups of cycloalkenyl, alkynyl, heterocyclic ring, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imide, ureido, sulfamoylamino, alkoxycarbonylamino, aryloxycarbonylamino, alkoxycarbonyl, aryloxycarbonyl and heterocyclic thio, as well as spiro compound residual groups, bridged hydrocarbon compound residual groups, etc.

The alkyl group represented by R may preferably be an alkyl group having 1 to 32 carbon atoms, which may be of straight-chain or branched-chain types.

The aryl group represented by R may preferably be a phenyl group.

The acylamino group represented by R may include an alkylcarbonylamino group, an arylcarbonylamino group, etc.

The sulfonamide group represented by R may include an alkylsulfonylamino group, an arylsulfonylamino group, etc.

The alkyl component or aryl component in the alkylthio group or arylthio group represented by R may include the above alkyl group or aryl group represented by R, respectively.

The alkenyl group represented by R may preferably be an alkenyl group having 2 to 32 carbon atoms; and the cycloalkyl group, a cycloalkyl group having 3 to 12, particularly 5 to 7, carbon atoms. The alkenyl group may be of straight-chain or branched-chain types.

The cycloalkenyl group represented by R may preferably be a cycloalkenyl group having 2 to 12, particularly 5 to 7, carbon atoms.

the sulfonyl group represented by R may include an alkylsulfonyl group, an arylsulfonyl group, etc.;

the sulfinyl group, an alkylsulfinyl group, an arylsulfinyl group, etc.;

the phosphonyl group, an alkylphosphonyl group, an alkoxyphosphonyl group, an aryloxyphosphonyl group, an arylphosphonyl group, etc.;

the acyl group, an alkylcarbonyl group, an arylcarbonyl group, etc.;

the carbamoyl group, an alkylcarbamoyl group, an arylcarbamoyl group, etc.;

the sulfamoyl group, an alkylsulfamoyl group, an arylsulfamoyl group, etc.;

the acyloxy group, an alkylcarbonyloxy group, an arylcarbonyloxy group, etc.;

the carbamoyloxy group, an alkylcarbamoyloxy group, an arylcarbamoyloxy group, etc.;

the ureido group, an alkylureido group, an arylureido group, etc.;

the sulfamoylamino group, an alkylsulfamoylamino group, an arylsulfamoylamino group, etc.;

the heterocyclic group may preferably be a heterocyclic group of 5 to 7 members, specifically a 2-furyl group, a 2-thienyl group, a 2-pyrimidinyl group, a 2-benzothiazolyl group, etc.;

the heterocyclic oxy group may preferably be a heterocyclic oxy group having a heterocyclic ring of 5 to 7 members as exemplified by a 3,4,5,6-tetrahydropyranyl-2-oxy group, a 1-phenyltetrazole-5-oxy group, etc.;

the heterocyclic thio group may preferably be a heterocyclic thio group of 5 to 7 members as exemplified by a 2-pyridylthio group, a 2-benzothiazolylthio group, a 2,4-diphenoxy-1,3,5-triazole-6-thio group, etc.;

the siloxy group, a trimethylsiloxy group, a triethylsiloxy group, a dimethylbutylsiloxy group, etc.;

the imide group, a succinimide group, a 3-heptadecylsuccinimide group, a phthalimide group, a glutalimide group, etc.;

the spiro compound residual group, spiro[3.3]heptan-1-yl, etc.; and the bridged hydrocarbon compound residual group, bicyclo[2.2.1]heptan-1-yl, tricyclo[3.3.1.1$^{3,7}$]decan-1-yl, 7,7-dimethyl-bicyclo[2.2.1]heptan-1-yl, etc.

The group represented by X and capable of being split off through the reaction with an oxidized product of a color developing agent may include, for example, a halogen atom (such as a chlorine atom, a bromine atom and a fluorine atom) and the groups such as alkoxy, aryloxy, heterocyclic oxy, acyloxy, sulfonyloxy, alkoxycarbonyloxy, aryloxycarbonyl, alkyloxazyloxy, alkoxyoxazyloxy, alkylthio, arylthio, heterocyclic thio, alkyloxythiocarbonylthio, acylamino, sulfonamide, a nitrogen-containing heterocyclic ring linked with an N atom, alkyloxycarbonylamino, aryloxycarbonylamino, carboxyl and

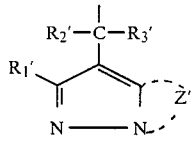

($R_1'$ has the same definition as in the above R; Z' has the same definition as the above Z; and $R_2'$ and $R_3'$ each represents a hydrogen atom, an aryl group, an alkyl group or a heterocyclic group), but preferably includes a halogen atom, particularly a chlorine atom.

The nitrogen-containing heterocyclic ring formed by Z or Z' may include a pyrazole ring, an imidazole ring, a triazole ring or tetrazole ring, etc., and the substituent the above ring may have may include those described for the above R.

The magenta coupler represented by Formula (M-I) is more specifically represented by, for example, Formulas (M-II) to (M-VII) shown below, respectively.

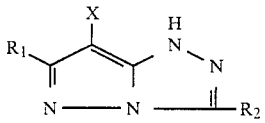

(M-II)

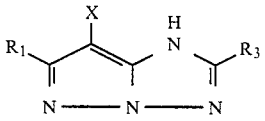

(M-III)

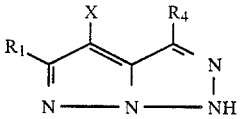

(M-IV)

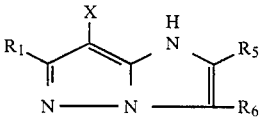

(M-V)

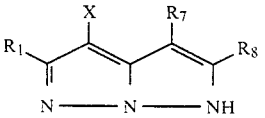

(M-VI)

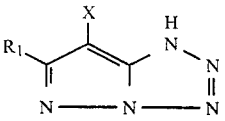

(M-VII)

In the above Formulas (M-II) to (M-VII), $R_1$ to $R_8$ and X have the same definition as the above R and X, respectively.

Most preferred among Formula (M-I) is a compound represented by Formula (M-VIII) shown below.

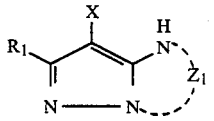

Formula (M-VIII)

In the formula, $R_1$, X and $Z_1$ have the same definition as R, X and Z in Formula (M-I), respectively.

Of the magenta couplers represented by Formulas (M-II) to (M-VII), particularly preferred is the magenta coupler represented by Formula (M-II).

Most preferred as the substituents R and $R_1$ on the above heterocyclic ring is a substituent represented by Formula (M-IX) shown below.

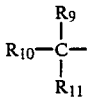

Formula (M-IX)

In the formula, $R_9$, $R_{10}$ and $R_{11}$ each have the same definition as the above R.

Any two of the above $R_9$, $R_{10}$ and $R_{11}$, for example, $R_9$ and $R_{10}$ may be combined to form a saturated or unsaturated ring (for example, cycloalkane, cycloalkene or a heterocyclic ring), or $R_{11}$ may further be combined to said ring to constitute a bridged hydrocarbon compound residual group.

Particularly preferred among Formula (M-IX) is (i) an instance in which at least two of $R_9$ to $R_{11}$ are each an alkyl group, and (ii) an instance in which any one of $R_9$ to $R_{11}$, for example, $R_{11}$ is a hydrogen atom and the other two of $R_9$ and $R_{10}$ are combined to form a cycloalkyl together with a route carbon atom.

Further preferred among (i) is an instance in which any two of $R_9$ to $R_{11}$ are each an alkyl group and the other one is a hydrogen atom or an alkyl group.

The substituent the ring formed by Z in Formula (M-I) or the ring formed by $Z_1$ in Formula (M-VIII) may have and $R_2$ to $R_8$ in Formulas (M-II) to (M-VI) may preferably be a compound represented by Formula (X) shown below. Formula (M-X):

$$-R_{12}-SO_2-R_{13}-$$

In the formula, $R_{12}$ represents an alkylene group, and $R_{13}$ represents an alkyl group, a cycloalkyl group or an aryl group.

The alkylene group represented by $R_{12}$ may preferably have a carbon atom number of 2 or more, more preferably 3 to 6, at the part of the straight-chain, and may be of either straight-chain or branched-chain types.

The cycloalkyl group represented by $R_{13}$ may preferably be a cycloalkyl group of 5 or 6 members.

Typical examples of the above compounds according to the present invention are shown below.

1

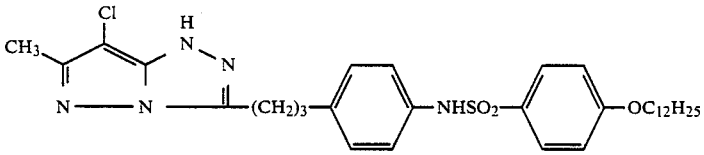

2

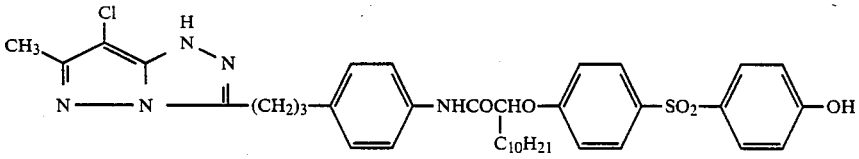

3

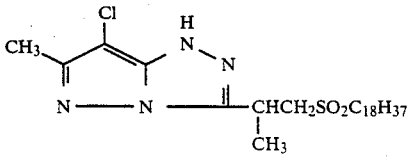

4

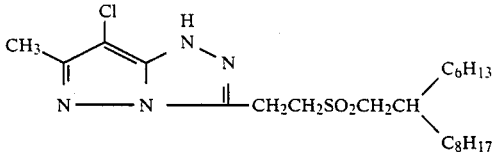

5

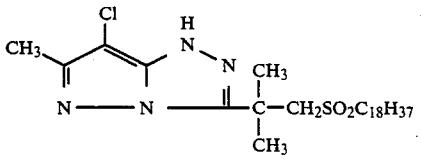

-continued
6
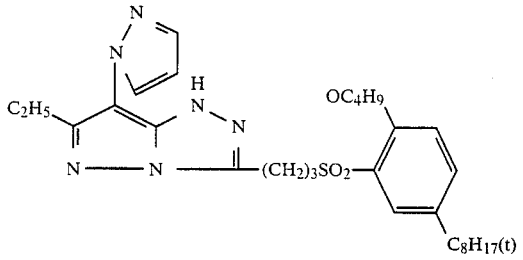
7
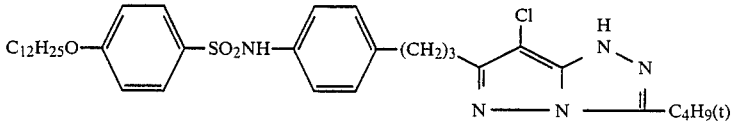
8
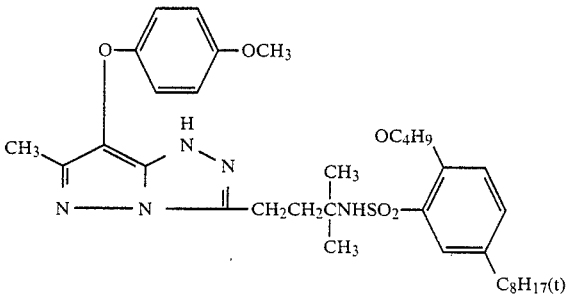
9
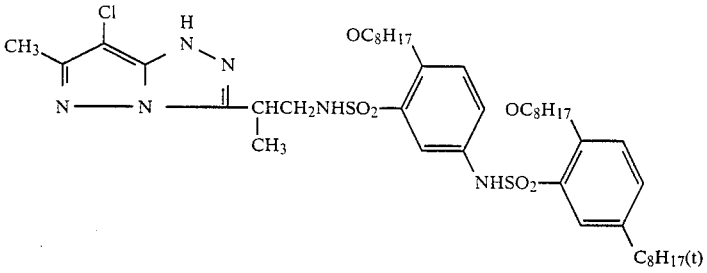
10
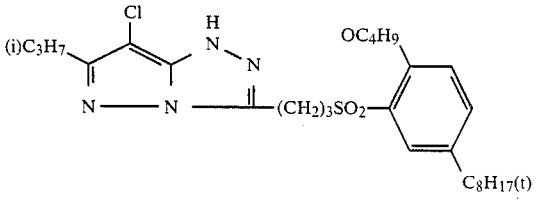
11
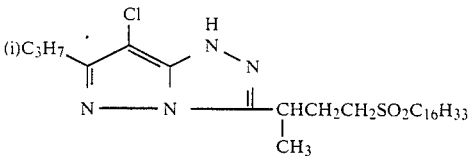
12
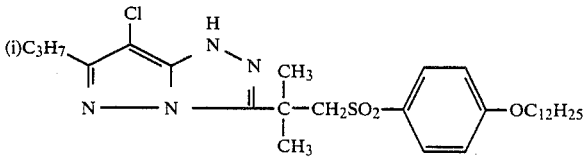

-continued
13
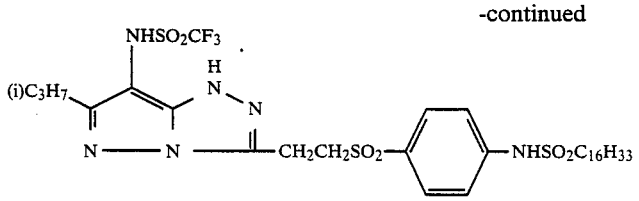
14
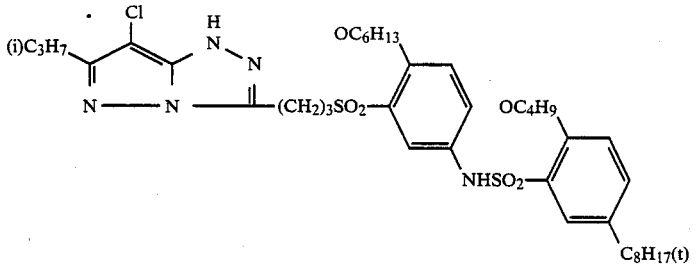
15
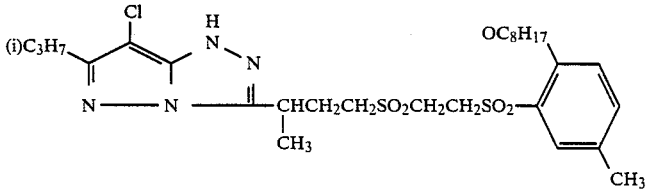
16
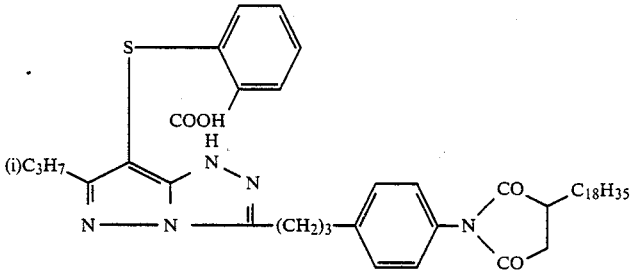
17
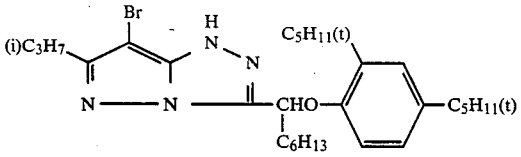
18
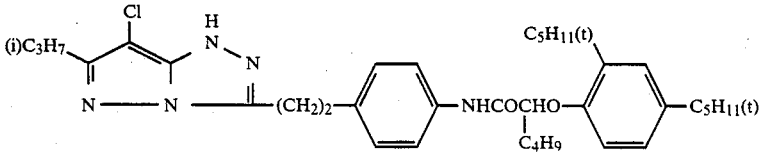
19
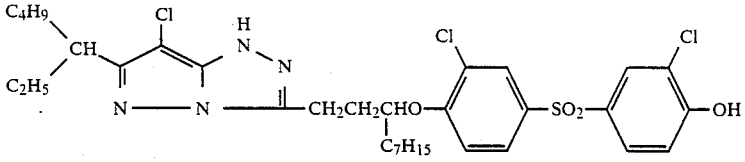
20
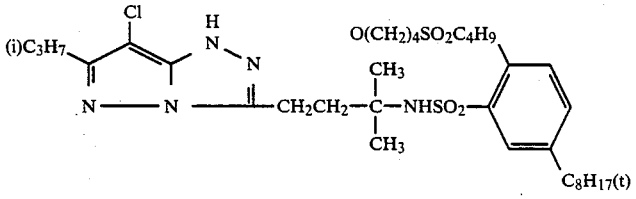

-continued
21
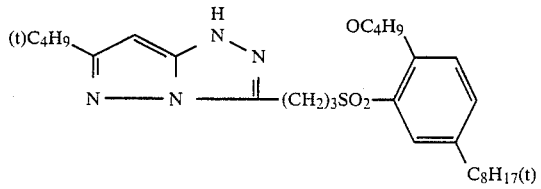
22
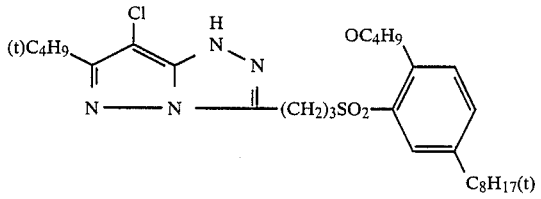
23
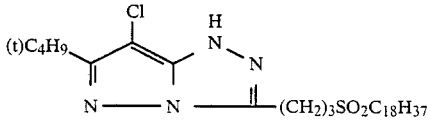
24
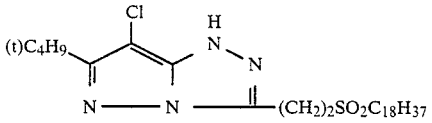
25
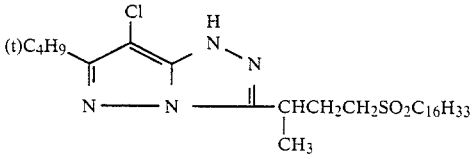
26
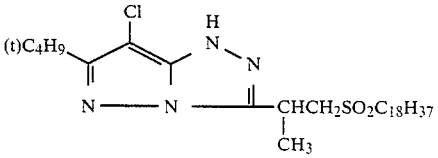
27
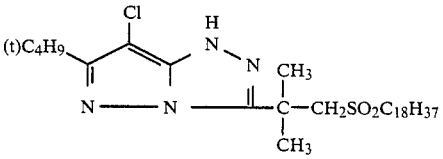
28
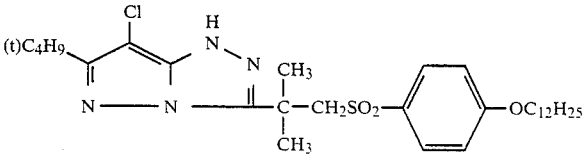
29
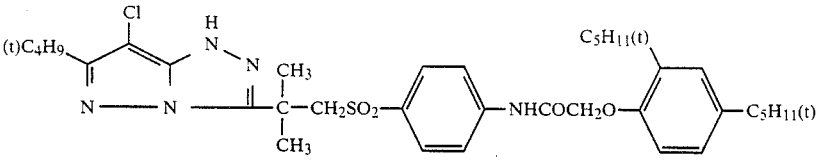
30
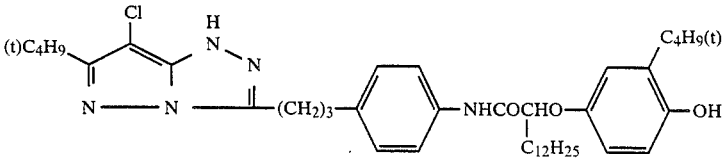

-continued

31

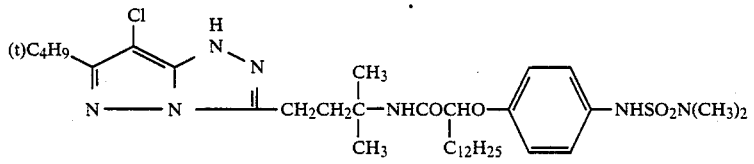

32

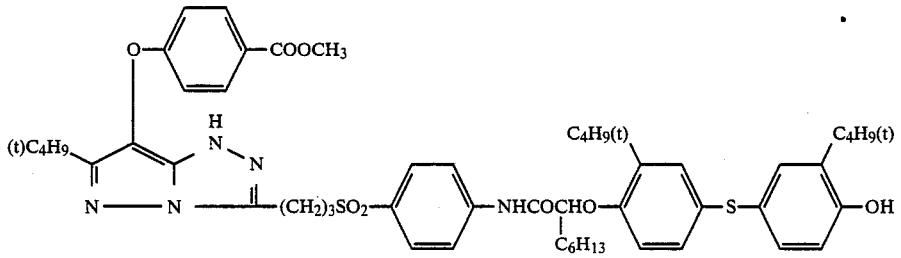

33

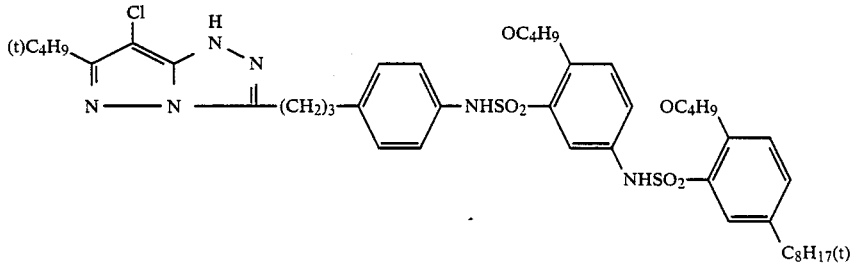

34

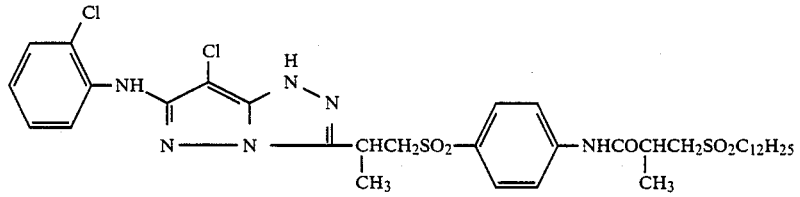

35

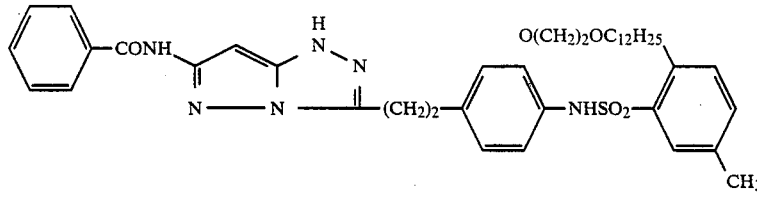

In addition to the above typical examples of the compound according to the present invention, examples of the compound according to the present invention may also include the compounds shown as Nos. 1 to 4, 6, 8 to 17, 19 to 24, 26 to 43, 45 to 59, 61 to 104, 106 to 121, 123 to 162 and 164 to 223 among the compounds described at pages 66 to 122 of Japanese Patent O.P.I. Publication No. 66339/1987.

The magenta couplers represented by the above Formula (M-I) (hereinafter referred to as the magenta couplers of the present invention) can be synthesized by making reference to Journal of the Chemical Society, Perkin I (1977), 2047–2052, U.S. Pat. No. 3,725,067, Japanese Patent O.P.I. Publications Nos. 99437/1984, 42045/1983, 162548/1984, 171956/1984, 33552/1985, 43659/1985, 172982/1985, 190779/1985, etc.

The couplers of the present invention can be used usually in the range of $1\times10^{-3}$ mol to 1 mol, preferably $1\times10^{-2}$ mol to $8\times10^{-1}$ mol, per mol of silver halide.

The couplers of the present invention can also be used by simultaneous use of two or more ones, or in combination with magenta couplers of different types.

The compounds represented by the above Formula (I) will be described below.

Examples of the aliphatic groups represented by $R^1$, $R^2$ and $R^3$ may include an alkyl group having 1 to 32 carbon atoms, an alkenyl group, an alkynyl group, a cycloalkyl group, a cycloalkenyl group, etc. The alkyl group, the alkenyl group and the alkynyl group may be of straight-chain or branched-chain type. These aliphatic groups also include those having a substituent.

Examples of the aromatic groups represented by $R^1$, $R^2$ and $R^3$ may include aryl groups (as exemplified by a phenyl group, etc.), aromatic heterocyclic groups (as exemplified by a pyridyl group, a furyl group, etc.). These aromatic groups also include those having a substituent.

$R^1$, $R^2$ and $R^3$ may each preferably be an alkyl group or an aryl group, and $R^1$, $R^2$ and $R^3$ *may each be the same or different, provided that the total sum of the carbon atoms of* $R^1$, $R^2$ and $R^3$ may preferably be 6 to 50.

There is no particular limitation in the substituent for the aliphatic groups or aromatic groups represented by $R^1$, $R^2$ and $R^3$, but it may preferably include an alkoxy group, an aryloxy group, an acyl group, an acyloxy group, an alkoxycarbonyl group, an aryloxycarbonyl group, a carbamoyl group, a sulfamoyl group, an acylamino group, an amino group, etc.

Symbols 1, m and n each represent 0 or 1, but 1, m and n each are not 1 at the same time. In other words, this indicates that at least one of the aliphatic groups or aromatic groups represented by $R^1$, $R^2$ and $R^3$ is directly bonded to the phosphorus atom.

Typical examples of the compounds represented by Formula (I) (hereinafter referred to as the compounds of the present invention) are shown below, but the present invention is by no means limited by these.

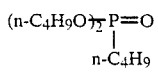
I-1

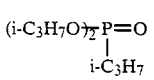
I-2

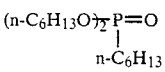
I-3

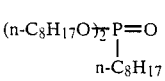
I-4

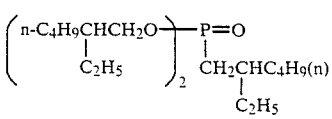
I-5

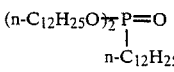
I-6

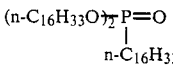
I-7

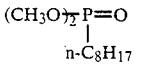
I-8

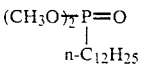
I-9

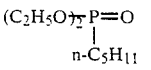
I-10

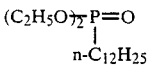
I-11

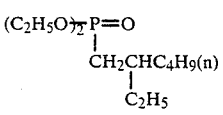
I-12

-continued

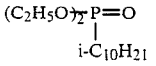
I-13

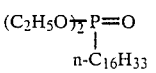
I-14

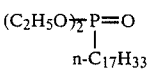
I-15

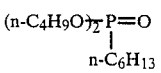
I-16

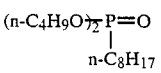
I-17

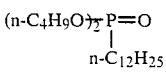
I-18

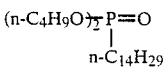
I-19

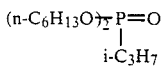
I-20

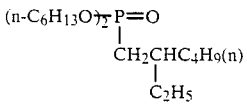
I-21

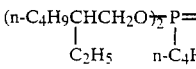
I-22

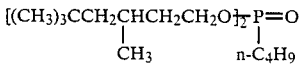
I-23

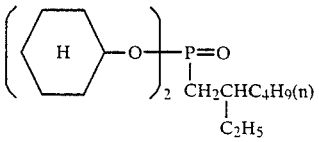
I-24

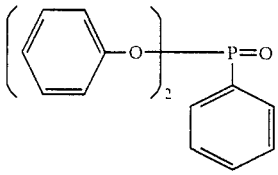
I-25

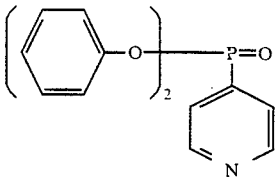
I-26

-continued
I-27
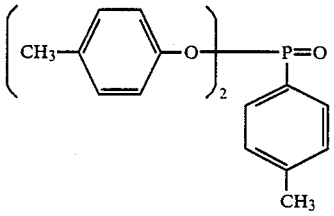
I-28
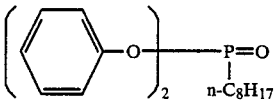
I-29
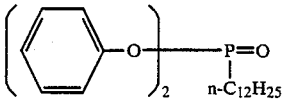
I-30
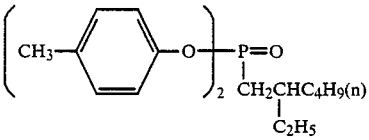
I-31
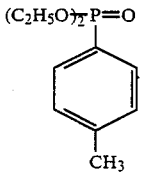
I-32
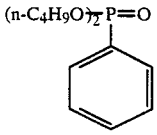
I-33
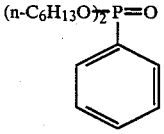
I-34
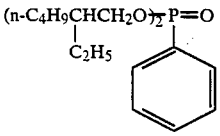
I-35
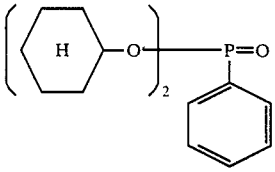
I-36
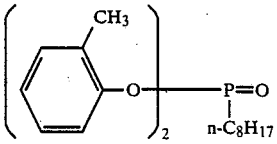
-continued
I-37
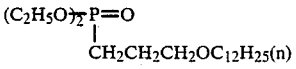
I-38
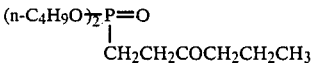
I-39
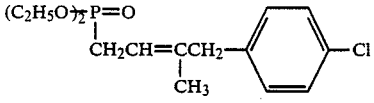
I-40
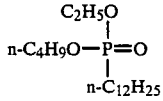
I-41
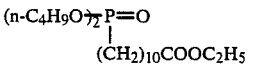
I-42
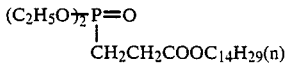
I-43
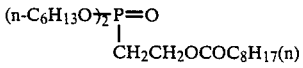
I-44
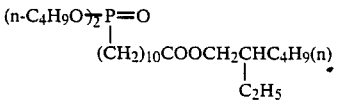
I-45
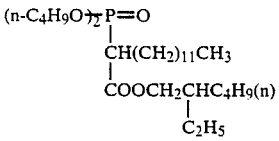
I-46
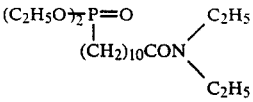
I-47
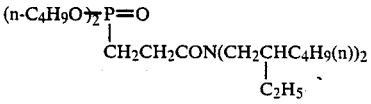
I-48
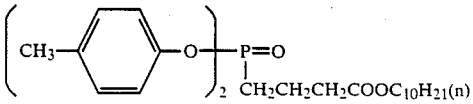
I-49
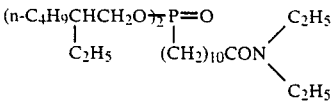
I-50
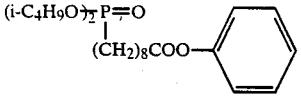
I-51
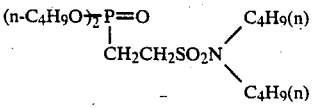

-continued
I-52
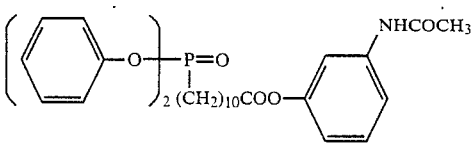
I-54
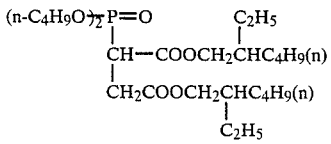
I-55
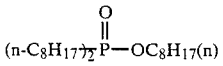
I-56
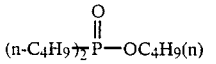
I-57
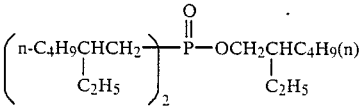
I-58
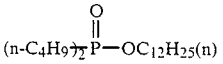
I-59
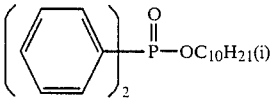
I-60
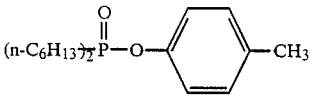
I-61
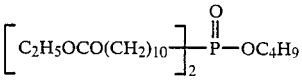
I-62
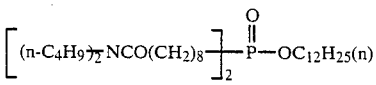
I-63
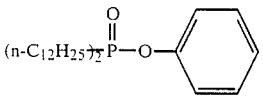
I-64
$(C_2H_5)_3P{=}O$
I-65
$(n\text{-}C_4H_9)_3P{=}O$
I-66
$(i\text{-}C_4H_9)_3P{=}O$
I-67
$(n\text{-}C_5H_{11})_3P{=}O$
I-68
$(n\text{-}C_6H_{13})_3P{=}O$
-continued
I-69
$(n\text{-}C_8H_{17})_3P{=}O$
I-70
$(n\text{-}C_4H_9CH(C_2H_5)CH_2)_3P{=}O$
I-71
$[(CH_3)_3CCH_2CH(CH_3)CH_2CH_2]_3P{=}O$
I-72
$(n\text{-}C_{10}H_{21})_3P{=}O$
I-73
$(i\text{-}C_{10}H_{21})_3P{=}O$
I-74
$(n\text{-}C_{12}H_{25})_3P{=}O$
I-75
$(n\text{-}C_{14}H_{29})_3P{=}O$
I-76
$(n\text{-}C_{17}H_{33})_3P{=}O$
I-77
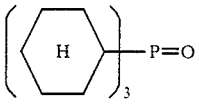
I-78
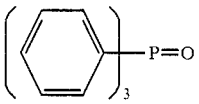
I-79
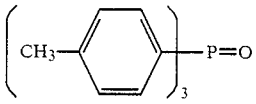
I-80
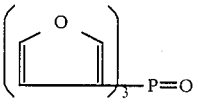
I-81
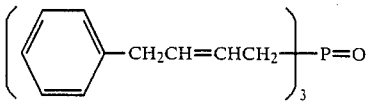
I-82
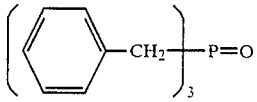
I-83
$[n\text{-}C_4H_9OCO(CH_2)_{10}]_3P{=}O$
I-84
$[(C_2H_5)_2NCO(CH_2)_{10}]_3P{=}O$
I-85
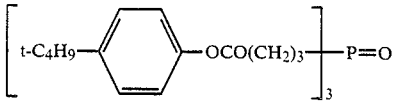
I-86
$(C_2H_5)_2P(=O)\text{-}C_{12}H_{25}(n)$ -continued

I-87

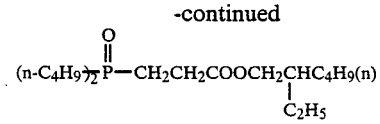

I-88

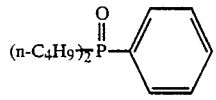

I-89

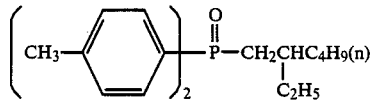

I-90

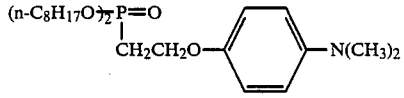

I-91

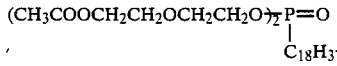

I-92

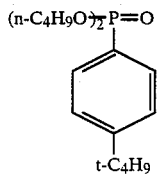

I-93

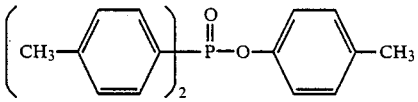

I-94

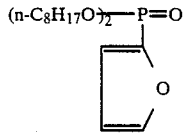

I-95

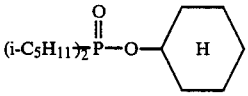

The compounds of the present invention include the compounds described at pages 4 to 5 of the specification of Japanese Patent O.P.I. Publication No. 19049/1981.

Some of the compounds of the present invention are commercially available, but they can be synthesized by the methods described, for example, in Japanese Patent O.P.I. Publication No. 19049/1981, British Patent No. 694,772, Journal of The American Chemistry, 1957, Vol. 79, page 6524 [J. Am. Chem. Soc., 79, 6524 (1957)]; Journal of Organic Chemistry, 1960, Vol. 25, page 1,000 [J. Org. Chem., 25, 1,000 (1960)]; Organic Synthesis, 1951, Vol 31, page 33 [Org. Synth., 31, 33 (1951)], etc.

The compounds of the present invention may preferably be used in an amount of from 5 to 500 mol %, more preferably from 10 to 300 mol %, based on the magenta coupler of the present invention.

A part of the compounds of the present invention is described in Japanese Patent O.P.I. Publication No. 19049/1981. However, the above publication does not suggest at all anything as to the fact that the compounds of the present invention can shift the maximum absorption wavelength of the magenta dye obtained from the pyrazoloazole type magenta coupler, to the short wavelength side and sharply reduce the absorption at the long wavelength side to zero, thus improving the color reproducibility.

More specifically, as a result of intensive studies, the present inventors discovered that the compounds of the present invention can shift the maximum absorption wavelength of the magenta dye obtained from the pyrazoloazole type magenta coupler, to the short wavelength side and reduce the absorption at the long wavelength side of 600 nm or more, so that the color reproducibility can be greatly improved, the image storage stability of the above magenta dye can be improved, and further the color-forming properties of the light-sensitive silver halide photographic material employing the above magenta coupler can be improved to attain a sufficiently high maximum density. Such effect has been obtained for the first time by the present invention.

The magenta couplers of the present invention and the compounds of the present invention are contained in at least one layer of silver halide emulsion layers, but particularly preferably contained in a green-sensitive silver halide emulsion layer.

Hydrophobic compounds such as the magenta couplers of the present invention and the compounds of the present invention can be added to the light-sensitive silver halide photographic material by using various methods such as a solid dispersion method, a latex dispersion method and an oil-in-water emulsion method. For example, in the oil-in-water emulsion method, the hydrophobic additives such as magenta couplers are usually dissolved in a high-boiling organic solvent having a boiling point of about 150° C. or more with optional use of a low-boiling and/or water-soluble organic solvent in combination, subjected to emulsification dispersion in a hydrophilic binder such as an aqueous gelatin solution with use of a surface active agent, and added to the intended hydrophilic colloid layers.

The light-sensitive silver halide photographic material of the present invention can be applied, for example, in color negative films and color positive films and also in color photographic paper, but, in particular, the effect of the present invention can be effectively exhibited when applied in color photographic paper used for direct viewing.

The light-sensitive silver halide photographic materials of the present invention, including this color photographic paper, may be those for use in monochrome or for use in multi-color. In the instance of the light-sensitive silver halide photographic material for use in multicolor, in which the color reproduction is effected by subtractive color process, it has the structure such that silver halide emulsion layers usually containing magenta, yellow and cyan couplers as photographic couplers and non-sensitive layers are laminated on a substrate in appropriate layer number and layer order. The layer number and layer order may be appropriately varied depending on what performances are weighted and what the light-sensitive materials are used for.

As the yellow coupler, there can be used benzoylacetanilide type compounds and pyvaloylacetanilide type compounds or the like. Examples thereof include those described in U.S. Pat. Nos. 2,875,057, 3,265,506, 3,408,194, 3,551,155, 3,582,322, 3,725,072 and 3,891,445, West German Pat. No. 15 47 868, West German Patent Publication Nos. 22 19 917 and 24 14 006, British Pat. No. 1,425,020, Japanese Patent Publication No. 10783/1976, Japanese Patent O.P.I. Publication Nos. 26133/1972, 73147/1973, 102636/1976, 6341/1975, 123342/1975, 130442/1975, 21827/1976, 87650/1975, 82424/1977 and 115219/1977, etc.

As the cyan coupler, there can be used phenol type compounds and naphthol type compounds or the like. Examples thereof include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Pat. application (OLS) Nos. 24 14 830 and 24 54 329, Japanese Patent O.P.I. Publication Nos. 59838/1973, 26034/1976, 5055/1973, 146828/1976, 69624/1977 and 90932/1977, etc.

According to a most preferred embodiment of the present invention, a silver halide emulsion layer containing a yellow coupler represented by Formula (Y-I) shown below and the compound represented by Formula (I) shown above is provided in addition to the silver halide emulsion layer containing the compounds represented respectively by the above Formulas (M-II) and (I), whereby the aimed color-reproducing effect can be made more remarkable.

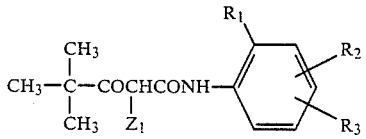
(Y-I)

wherein $R_1$ represents a halogen atom or an alkoxy group, $R_2$ represents a hydrogen atom or a group capable of being substituted on the benzene ring, $R_3$ represents a monovalent organic residual group, and $Z_1$ is a group capable of being split off upon reaction with the oxidized product of a color developing agent.

In Formula (Y-I), $R_1$ represents a halogen atom or an alkoxy group. The alkoxy group represented by $R_1$ includes those having a substituent, and such a substituent may include, for example, a halogen atom, an aryl group, an alkoxy group, an aryloxy group, an alkylsulfonyl group, an acylamino group, an alkoxycarbonyl group, an aryloxycarbonyl group, an acyloxy group, an acyl group, a hydroxyl group, etc.

Preferably, $R_1$ is a chlorine atom or an alkoxy group.

In Formula (Y-1), $R_2$ represents a hydrogen atom or a group capable of being substituted on the benzene ring. The group capable of being substituted on the benzene ring may include, a halogen atom, an alkyl group, an aryl group, an alkoxy group, an aryloxy group, an acyloxy group, an acylamino group, a carbamoyl group, an alkylsulfonamide group, an arylsulfonamide group, a sulfamoyl group, an imide group, etc.

Preferably, $R_2$ is a hydrogen atom.

In Formula (Y-1), the monovalent organic residual group represented by $R_3$ may include ballast groups well known in yellow couplers, as exemplified by an acylamino group, an alkoxycarbonyl group, an aryloxycarbonyl group, an alkylsulfamoyl group, an arylsulfamoyl group, an alkylsulfonamide group, an arylsulfonamide group, an alkylureido group, an arylureido group, a succinimido group, an alkoxy group, an aryloxy group, an alkylcarbamoyl group, an arylcarbamoyl group, an alkylsulfamoylamino group, an arylsulfamoylamino group, an alkyl group, an alkenyl group, an acyl group or an acyloxy group, etc.

In Formula (Y-1), $Z_1$ represents a group capable of being split off upon reaction with the oxidized product of a color developing agent, which is exemplified by the group represented by Formula (Y-II) or (Y-III).

$$-OR_4 \qquad \text{(Y-II)}$$

In Formula (Y-II), $R_4$ represents an aryl group or heterocyclic group that contains those having a substituent.

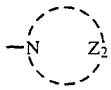
(Y-III)

In Formula (Y-III), $Z_2$ represents a group of non-metal atoms necessary to complete a 5- or 6-membered ring together with a nitrogen atom. Here the group of atoms necessary to complete the group of non-metal atoms may include, for example, methylene, methine, substituted methine, C=O, —NH—, —N=, —O—, —S—, $-SO_2-$, etc.

The yellow coupler represented by Formula (Y-I) may be combined at the part of $R_1$, $R_2$, $R_3$ or $Z_1$ to form a bis or more body.

Preferred as the yellow coupler of the present invention are those represented respectively by Formulas (Y-IV) and (Y-V) shown below.

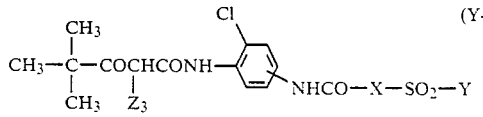
(Y-IV)

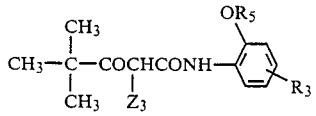
(Y-V)

In Formula (Y-IV), X represents an alkylene group, an arylene group, an alkylene arylene group, an arylene alkylene group or $-A-V_1-B-$ (A and B each represents an alkylene group, and arylene group, an alkylene arylene group or an arylene alkylene group, and $V_1$ represents a divalent connecting group.); and Y represents an alkyl group, a cycloalkyl group, an aryl group or a heterocyclic group. $Z_3$ represents a group capable of being split off when coupled with the oxidized product of a developing agent.

Typical examples of the yellow coupler represented by Formula (Y-I) are shown below, but the present invention is by no means limited by these.

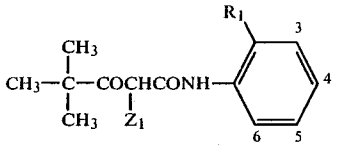
| Compound No. | $Z_1$ | $R_1$ | 4 | 5 |
|---|---|---|---|---|
| Y-1 | 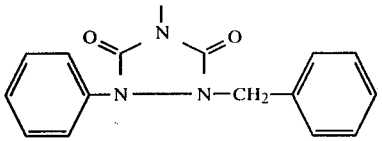 | —Cl | —H | 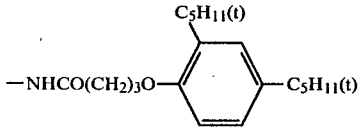 |
| Y-2 | 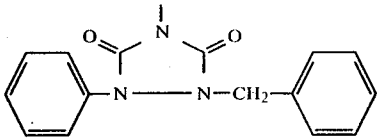 | —Cl | —H | 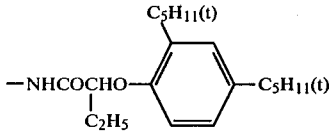 |
| Y-3 | 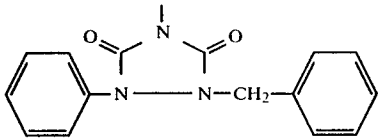 | —Cl | —H | $—SONHC_{12}H_{25}(n)$ |
| Y-4 | 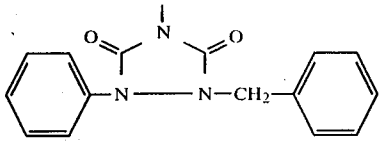 | —Cl | —H | $—COOCH(CH_3)COOC_{12}H_{25}(n)$ |
| Y-5 | 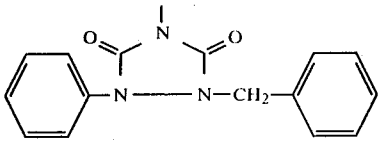 | —Cl | —H | 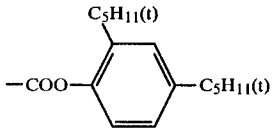 |

-continued
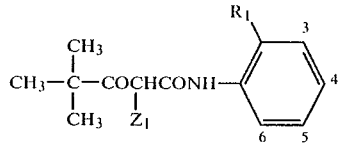
| Compound No. | $Z_1$ | $R_1$ | 4 | 5 |
|---|---|---|---|---|
| Y-6 | 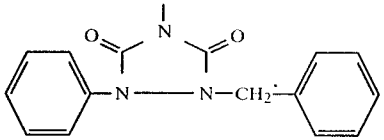 | —Cl | —H | —NHCO(CH$_3$)CH$_2$SO$_2$C$_{12}$H$_{25}$(n) |
| Y-7 | 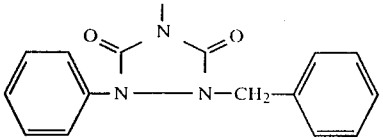 | —Cl | —H | —COO(CH$_3$)COOC$_2$H$_4$O—C$_6$H$_4$—OC$_{12}$H$_{25}$(n) |
| Y-8 | 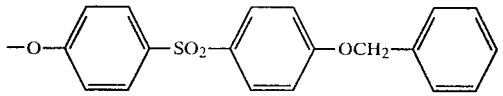 | —Cl | —H | —NHCO(CH$_2$)$_3$O—C$_6$H$_4$(C$_5$H$_{11}$(t))—C$_5$H$_{11}$(t) |
| Y-9 | 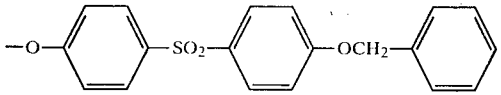 | —Cl | —H | —NHCO(C$_2$H$_5$)CHO—C$_6$H$_4$(C$_5$H$_{11}$(t))—C$_5$H$_{11}$(t) |
| Y-10 | 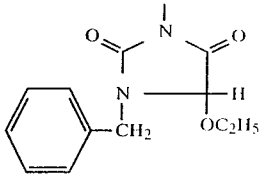 | —Cl | —H | —COOC$_{12}$H$_{25}$(n) |

-continued
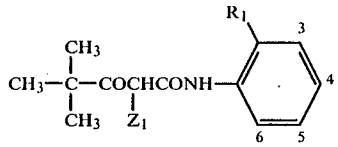
| Compound No. | $Z_1$ | $R_1$ | 4 | 5 |
|---|---|---|---|---|
| Y-11 | 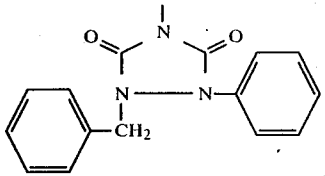 | —Cl | —H | —$COOC_{12}H_{25}(n)$ |
| Y-12 | 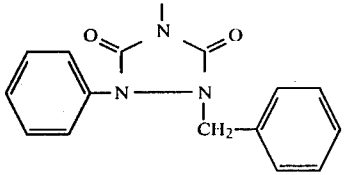 | —Cl | —H | —$COOCH(C_4H_9(iso))COOC_{12}H_{25}(n)$ |
| Y-13 | 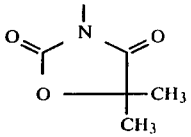 | —Cl | —H | 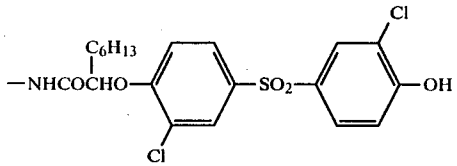 |
| Y-14 | 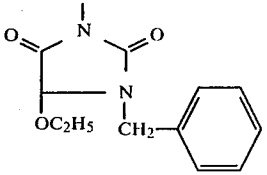 | —Cl | —H | 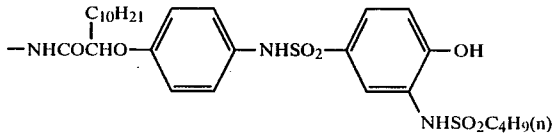 |

-continued
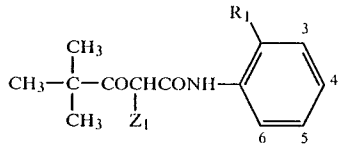
| Compound No. | $Z_1$ | $R_1$ | 4 | 5 |
|---|---|---|---|---|
| Y-15 | 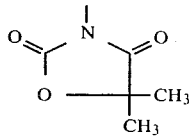 | —Cl | —H | 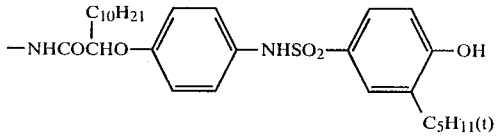 |
| Y-16 | 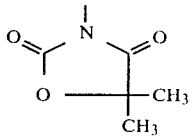 | —Cl | —H | 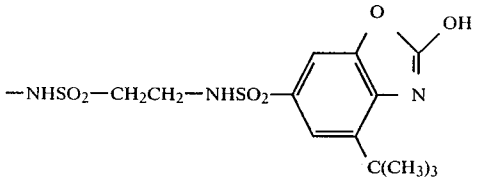 |
| Y-17 | 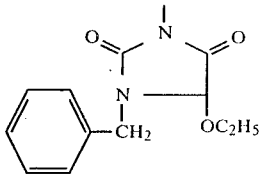 | —Cl | —H | 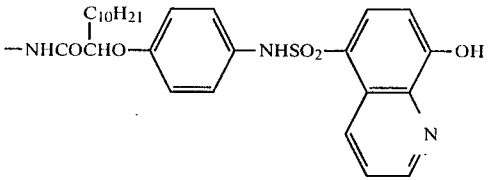 |
| Y-18 | 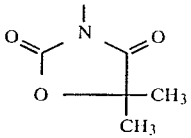 | —Cl | —H | 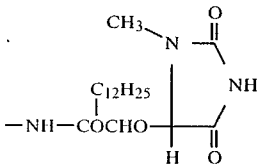 |

-continued
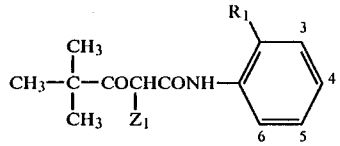
| Compound No. | $Z_1$ | $R_1$ | 4 | 5 |
|---|---|---|---|---|
| Y-19 | 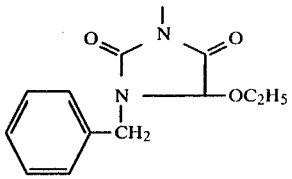 | —Cl | —H | 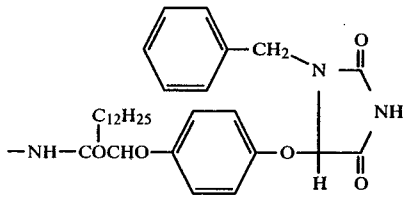 |
| Y-20 | 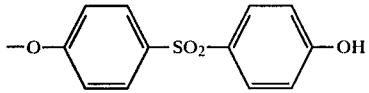 | —Cl | —H | 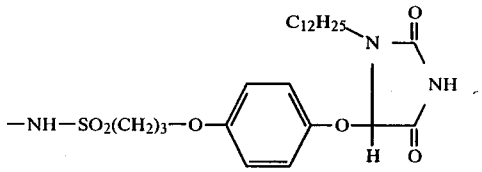 |
| Y-21 | 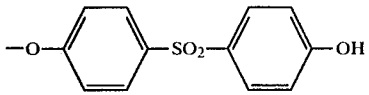 | —Cl | —H | 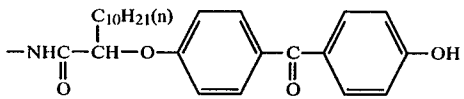 |
| Y-22 | 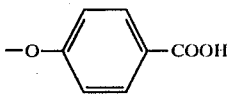 | —Cl | —H | 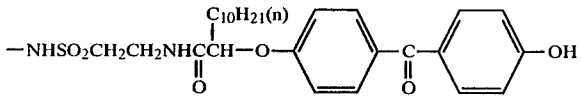 |
| Y-23 | 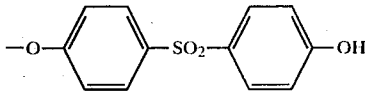 | —Cl | —H | 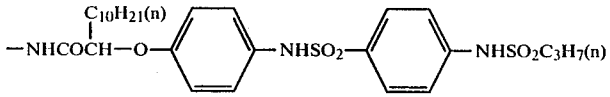 |

-continued
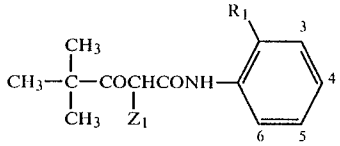
| Compound No. | $Z_1$ | $R_1$ | 4 | 5 |
|---|---|---|---|---|
| Y-24 | 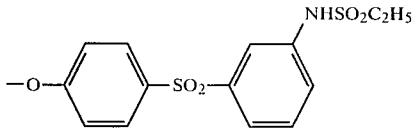 | —Cl | —H | 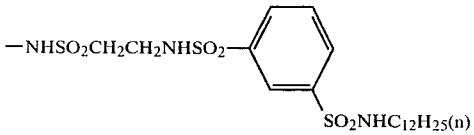 |
| Y-25 | 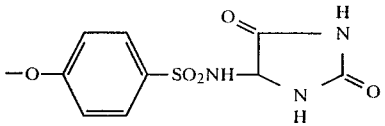 | —Cl | —H | 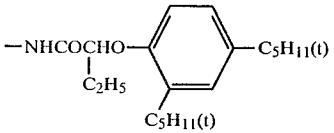 |
| Y-26 | 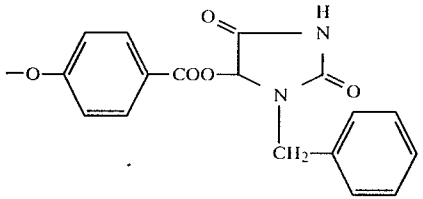 | —Cl | —H | $—NHSO_2C_{16}H_{33}$ |
| Y-27 | 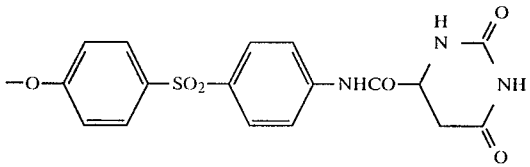 | —Cl | —H | $—COOC_{12}H_{25}$ |

-continued
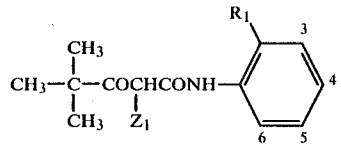
| Compound No. | $Z_1$ | $R_1$ | 4 | 5 |
|---|---|---|---|---|
| Y-28 | 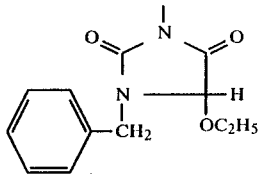 | —Cl | —H | 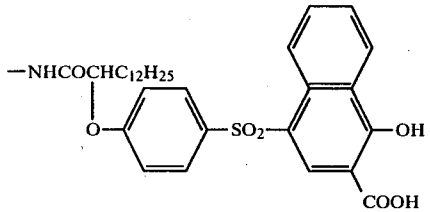 |
| Y-29 | 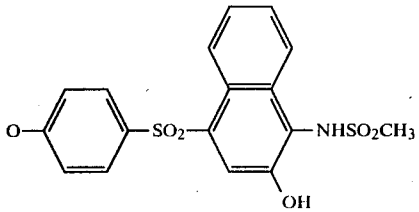 | —Cl | —H | $—NHCOC_{13}H_{27}$ |
| Y-30 | 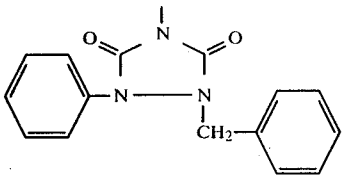 | —Cl | —H | 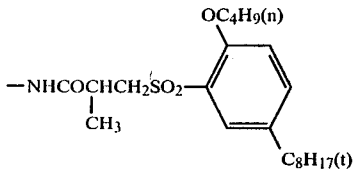 |

-continued
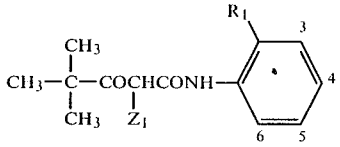
| Compound No. | $Z_1$ | $R_1$ | 4 | 5 |
|---|---|---|---|---|
| Y-31 | 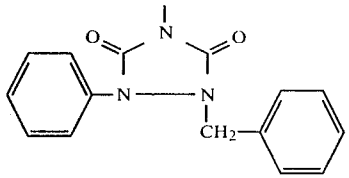 | —Cl | —H | —NHCOCHCH$_2$SO$_2$—(CH$_3$)—C$_6$H$_4$—OC$_{12}$H$_{25}$ |
| Y-32 | 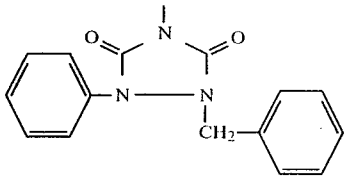 | —Cl | —H | —NHCOCHCH$_2$SO$_2$C$_{12}$H$_{25}$(n) (C$_2$H$_5$) |
| Y-33 | 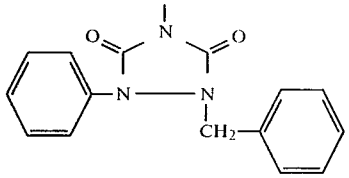 | —Cl | —H | —NHCOCHCH$_2$SO$_2$—(C$_2$H$_5$)—C$_6$H$_3$(OC$_4$H$_9$(n))—C$_8$H$_{17}$(t) |
| Y-34 | 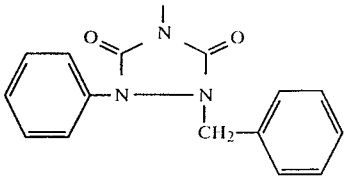 | —Cl | —H | —NHCOCHCH$_2$SO$_2$—(C$_2$H$_5$)—C$_6$H$_4$—OC$_{12}$H$_{25}$(n) |

-continued
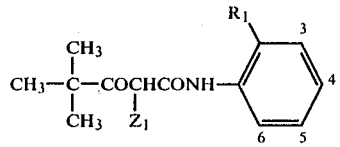
| Compound No. | $Z_1$ | $R_1$ | 4 | 5 |
|---|---|---|---|---|
| Y-35 | 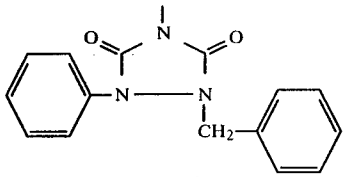 | —Cl | —H | 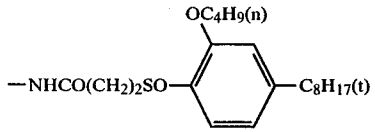 |
| Y-36 | 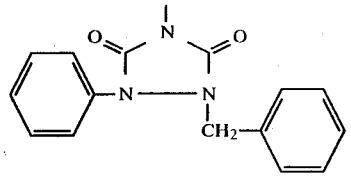 | —Cl | —H | 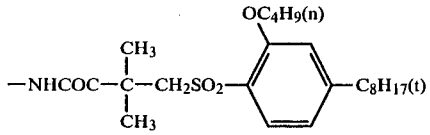 |
| Y-37 | 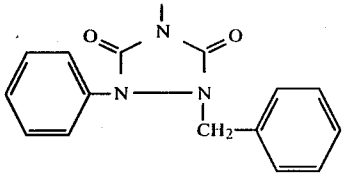 | —Cl | —H | 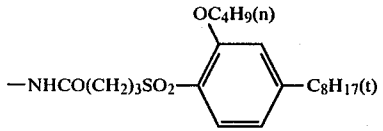 |
| Y-38 | 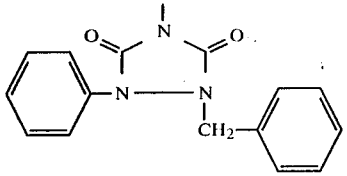 | —Cl | —H | 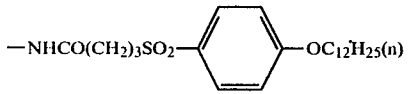 |

-continued
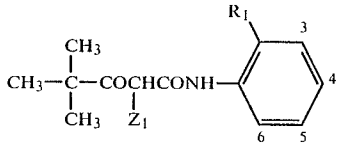
| Compound No. | $Z_1$ | $R_1$ | 4 | 5 |
|---|---|---|---|---|
| Y-39 | 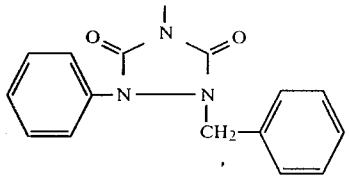 | —Cl | —H | —NHCO$(CH_2)_2SO_2C_{12}H_{25}$(n) |
| Y-40 | 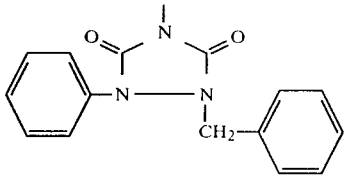 | —Cl | —H | —NHCO$(CH_2)_2SO_2$— 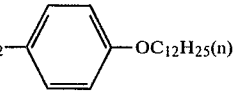 —$OC_{12}H_{25}$(n) |
| Y-41 | 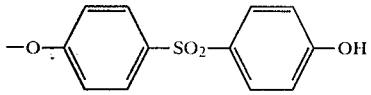 | —Cl | —H | —NHCO$(CH_2)_3O$— 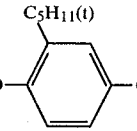 —$C_5H_{11}$(t) |
| Y-42 | 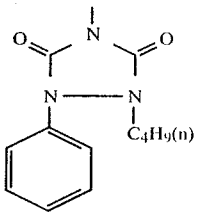 | —Cl | —H | —NHCO$(CH_2)_3O$— 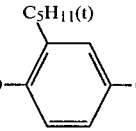 —$C_5H_{11}$(t) |

-continued
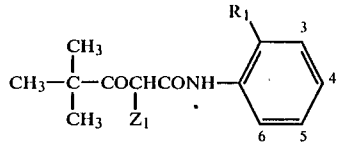
| Compound No. | $Z_1$ | $R_1$ | 4 | 5 |
|---|---|---|---|---|
| Y-43 | 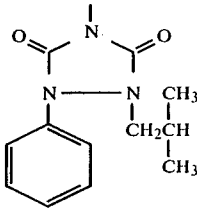 | —Cl | —H | —NHCO(CH$_3$)CHCHSO$_2$C$_{12}$H$_{25}$ |
| Y-44 | 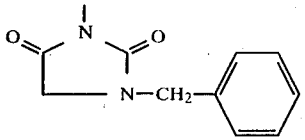 | —Cl | —H | 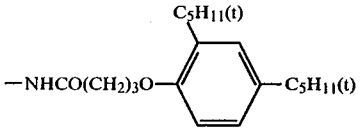 |
| Y-45 | 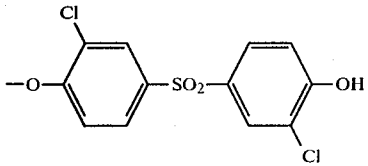 | —Cl | —H | —NHSO$_2$C$_{16}$H$_{33}$ |
| Y-46 | 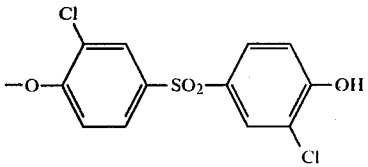 | —Cl | —H | 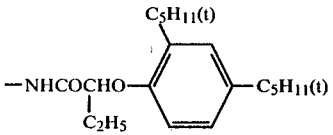 |

-continued
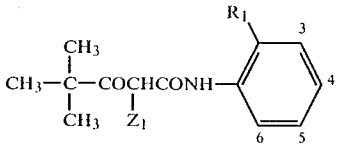
| Compound No. | $Z_1$ | $R_1$ | 4 | 5 |
|---|---|---|---|---|
| Y-47 | 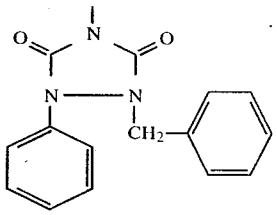 | —Cl | —H | —COOCHCOOC$_{12}$H$_{25}$ \| $C_2H_5$ |
| Y-48 | 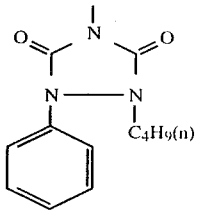 | —Cl | —H | —COOCHCOOC$_{12}$H$_{25}$ \| $C_2H_5$ |
| Y-49 | 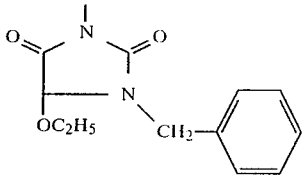 | —Cl | —H | 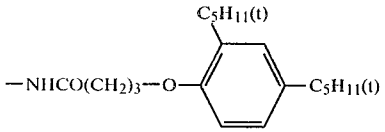 |

-continued
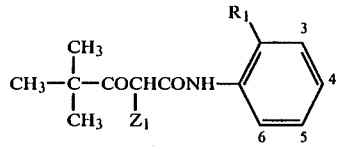
| Compound No. | $Z_1$ | $R_1$ | 4 | 5 |
|---|---|---|---|---|
| Y-50 | 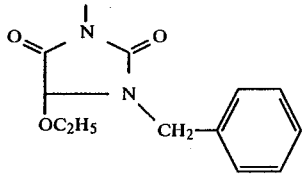 | —Cl | —H | 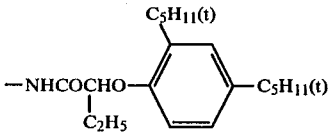 |
| Y-51 | 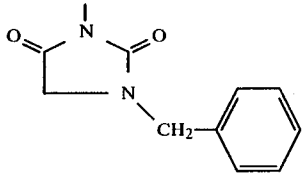 | —Cl | —H | $-COOCH(C_2H_5)COOC_{12}H_{25}$ |
| Y-52 | 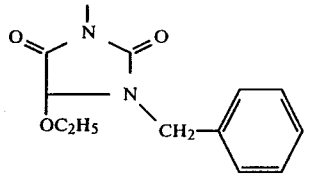 | —Cl | —H | $-COOCH(C_2H_5)COOC_{12}H_{25}$ |
| Y-53 | 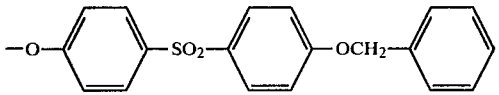 | —Cl | —H | $-NHCO(CH_2)_3SO_2C_{12}H_{25}$ |

-continued
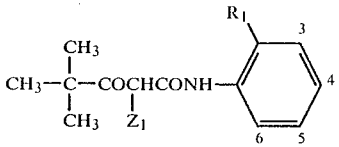
| Compound No. | $Z_1$ | $R_1$ | 4 | 5 |
|---|---|---|---|---|
| Y-54 | 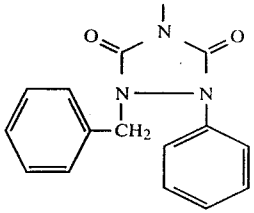 | —Cl | —H | —$NHSO_2C_{12}H_{25}$ |
| Y-55 | 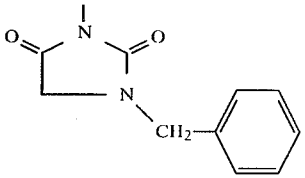 | —Cl | —H | —$COOCH(C_4H_9)COOC_{12}H_{25}$ |
| Y-56 | 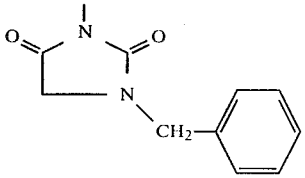 | —Cl | —H | —$COOC_{12}H_{25}$ |
| Y-57 | 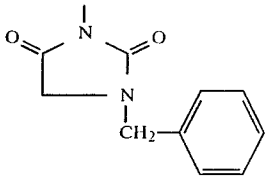 | —Cl | —H | —$CONHCH(CH_3)COO(CH_2)_2O$— 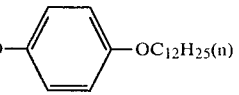 —$OC_{12}H_{25}(n)$ |

-continued
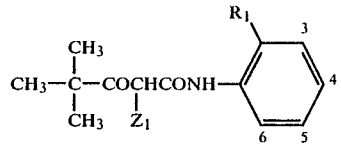
| Compound No. | $Z_1$ | $R_1$ | 4 | 5 |
|---|---|---|---|---|
| Y-58 | 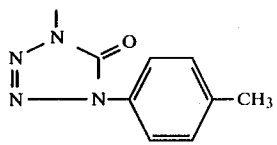 | —Cl | —H | —NHCO(CH$_3$)CHCH$_2$SO$_2$C$_{12}$H$_{25}$(n) |
| Y-59 | 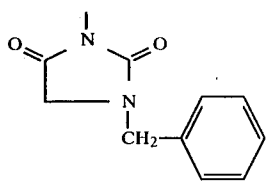 | —Cl | —H | —NHCO(CH$_3$)CHCH$_2$SO$_2$C$_{12}$H$_{25}$(n) |
| Y-60 | 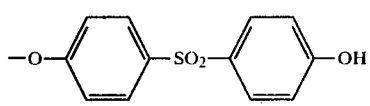 | —Cl | —H | —NHCO(CH$_3$)$_2$CHCH$_2$SO$_2$C$_{12}$H$_{25}$(n) |
| Y-61 | 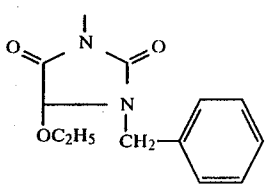 | —Cl | —H | —NHCO(CH$_3$)CHCH$_2$SO$_2$C$_{12}$H$_{25}$(n) |

-continued
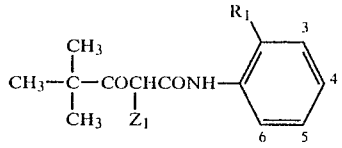
| Compound No. | $Z_1$ | $R_1$ | 4 | 5 |
|---|---|---|---|---|
| Y-62 | 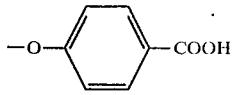 | —Cl | —H | 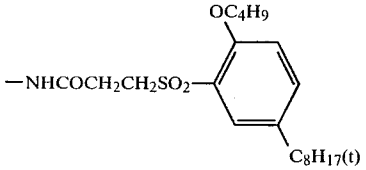 |
| Y-63 | 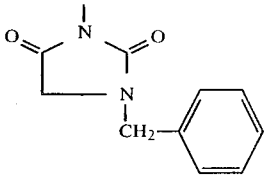 | —Cl | —H | $-NHCO(CH_2)_3SO_2CH_2CH(C_6H_{13}(n))C_8H_{17}(n)$ |
| Y-64 | 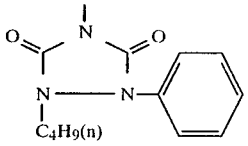 | $-OCH_3$ | —H | $-NHCO(CH_3)CHCH_2SO_2C_{12}H_{25}(n)$ |
| Y-65 | 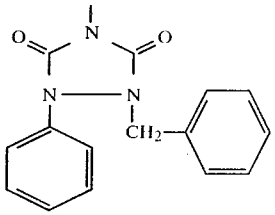 | $-OCH_3$ | —H | $-NHCO(CH_3)_2C-CH_2SO_2C_{12}H_{25}(n)$ |

-continued
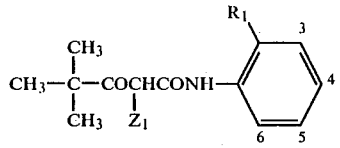
| Compound No. | $Z_1$ | $R_1$ | 4 | 5 |
|---|---|---|---|---|
| Y-66 | 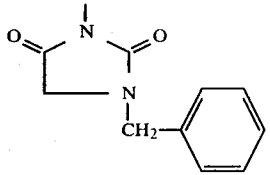 | $-OCH_3$ | $-H$ | $-COOCH(C_4H_9)COOC_{12}H_{25}$ |
| Y-67 | 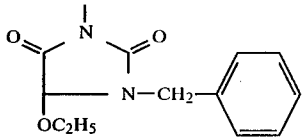 | $-OCH_3$ | $-H$ | $-NHCO(CH_3)CHCH_2SO_2C_{12}H_{25}(n)$ |
| Y-68 | 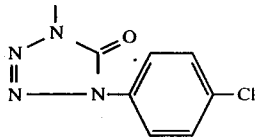 | $-OC_2H_5$ | $-H$ | 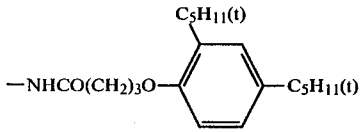 |
| Y-69 | 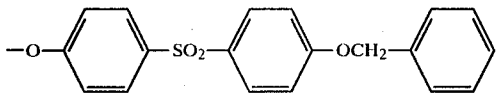 | $-OCH_3$ | $-H$ | $-NHSO_2C_{16}H_{33}(n)$ |
| Y-70 | 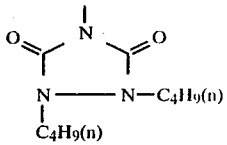 | $-OCH_3$ | $-H$ | $-COOC_{12}H_{25}(n)$ |

-continued
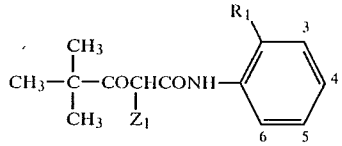
| Compound No. | $Z_1$ | $R_1$ | 4 | 5 |
|---|---|---|---|---|
| Y-71 | 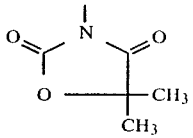 | $-OC_3H_7(i)$ | $-H$ | $-SO_2NHC_{12}H_{25}(n)$ |
| Y-72 | 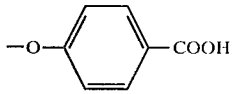 | $-OC_4H_9(n)$ | $-H$ | 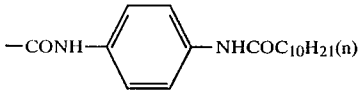 |
| Y-73 | 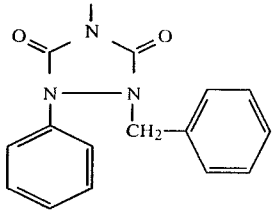 | $-OC_{12}H_{25}(n)$ | $-H$ | $-NHCO(CH_2)_2SO_2NHCH_2CHC_4H_9(n)$ $\vert$ $C_2H_5$ |
| Y-74 | 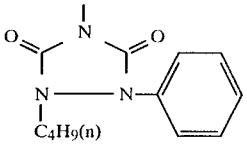 | $-OCH_2CH_2OCH_3$ | $-H$ | $-NHCOCHCH_2SO_2C_{12}H_{25}(n)$ $\vert$ $CH_3$ |
| Y-75 | 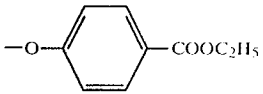 | $-OCH_2CH_2OCOCH_3$ | $-H$ | 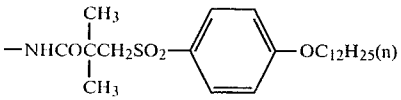 |

-continued
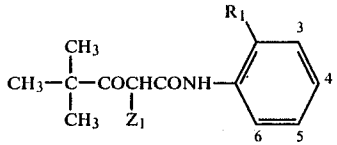
| Compound No. | $Z_1$ | $R_1$ | 4 | 5 |
|---|---|---|---|---|
| Y-76 | 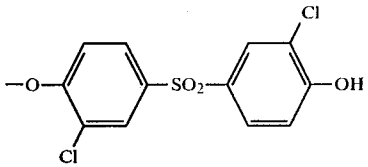 | $-OCH_3$ | $-H$ | $-NHSO_2C_{14}H_{29}(n)$ |
| Y-77 | 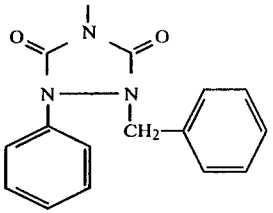 | $-OCH_3$ | $-H$ | $-COOCH(CH_3)COOC_{12}H_{25}(n)$ |
| Y-78 | 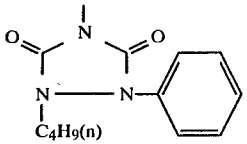 | $-OCH_3$ | $-H$ | $-NHSO_2C_{16}H_{33}(n)$ |
| Y-79 | 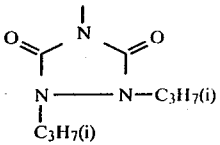 | $-OCH_3$ | $-Cl$ | 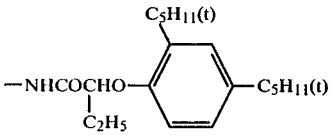 |

-continued
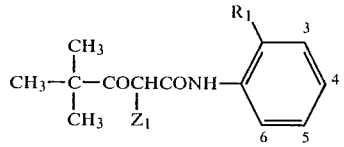
| Compound No. | $Z_1$ | $R_1$ | 4 | 5 |
|---|---|---|---|---|
| Y-80 | 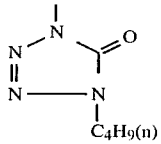 | —Cl | 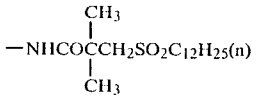 | —H |
| Y-81 | 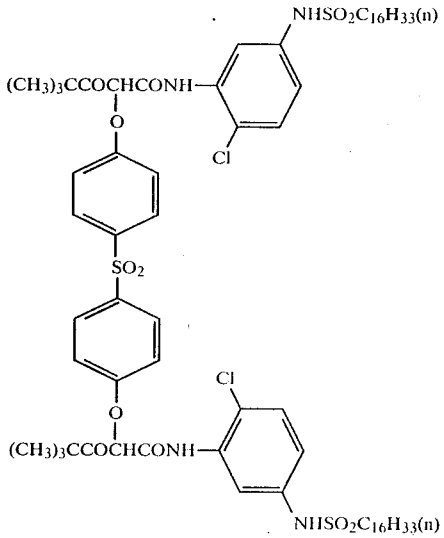 | | | |

These yellow couplers further include the exemplary compounds described at pages 4 to 8 of Japanese Patent O.P.I. Publication No. 70841/1980 and pages 20 to 26 of Japanese patent application No. 269216/1986.

These yellow couplers can be readily synthesized following the methods described, for example, in Japanese Patent O.P.I. Publications Nos. 155538/1982, 6652/1986, 70841/1980, 24321/1972 and 66834/1973, Japanese Patent Examined Publication No. 19031/1971, Japanese patent application No. 269216/1986, etc.

These yellow couplers may be used alone or in combination of two or more kinds.

These yellow couplers are used in the range of from 0.02 to 1 mol, preferably from 0.05 to 0.75 mol, per mol of silver halide.

In the silver halide emulsion used in the light-sensitive silver halide photographic material of the present invention (hereinafter referred to as the silver halide emulsion of the present invention), any of silver halides can be used, including silver bromide, silver iodobromide, silver iodochloride, silver chlorobromide, silver chloride, etc. that are used in ordinary silver halide emulsions.

The silver halide emulsion of the present invention is chemically sensitized by sulfur sensitization, selenium sensitization, reduction sensitization, noble metal sensitization or the like.

The silver halide emulsion of the present invention can be optically sensitized to a desired wavelength region by using dyes known as sensitizing dyes in the photographic industrial field.

In the light-sensitive silver halide photographic material of the present invention, it is possible to optionally use color-fogging preventive agents, hardening agents, plasticizers, polymer latex, ultraviolet absorbents, formalin scavengers, mordants, development accelerators, development restrainers, brightening agents, matting agents, lubricants, antistatic agents, surface active agents, etc.

The light-sensitive silver halide photographic material of the present invention can form images by carrying out various color development processings.

The light-sensitive silver halide photographic material of the present invention can form images by carrying out various color development processings.

The light-sensitive silver halide photographic material of the present invention, which contains the magenta coupler of the present invention and the compound of the present invention, can be improved in the spectral absorption characteristics of the magenta dye image formed by the pyrazoloazole type magenta coupler, and, as a result, can be greatly improved in the color reproducibility. There can be also improved the image storage stability of the magenta dye image, and the color-forming properties can also be enhanced, thus obtaining sufficient maximum density.

EXAMPLES

Specific examples of the present invention will be described below, but the working embodiments of the present invention are by no means limited to these.

EXAMPLE 1

(Preparation of Silver Halide Emulsion)

According to a neutral method and a simultaneous mixing method, prepared were 6 kinds of silver halide emulsions shown in Table 1.

After completion of the chemical sensitization, STB-1 shown below was added to each of the silver halide emulsions as an emulsion-stabilizing agent in an amount of $5\times10^{-3}$ mol per mol of silver halide.

TABLE 1

| Emulsion No. | AgCl (%) | AgBr (%) | Average grain size (μ) | Chemical sensitizing agent | Spectral sensitizing dye |
|---|---|---|---|---|---|
| Em-1 | 100 | 0 | 0.67 | | SD-1*3 |
| Em-2 | 99.5 | 0.5 | 0.46 | Sodium thiosulfate*1 | SD-2*4 |
| Em-3 | 99.5 | 0.5 | 0.43 | Chloroaurate*2 | SD-3*5 |
| Em-4 | 10 | 90 | 0.67 | | SD-1*3 |
| Em-5 | 30 | 70 | 0.46 | Sodium thiosulfate*1 | SD-2*4 |
| Em-6 | 30 | 70 | 0.43 | | SD-3*5 |

*1Added in amount of 2 mg per mol of silver halide.
*2Added in amount of $5\times10^{-5}$ mol per mol of silver halide.
*3Added in amount of 0.9 mmol per mol of silver halide.
*4Added in amount of 0.7 mmol per mol of silver halide.
*5Added in amount of 0.2 mmol per mol of silver halide.

[SD-1]

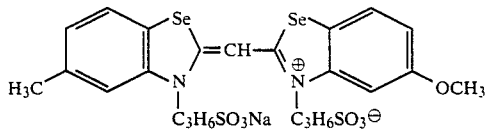

[SD-2]

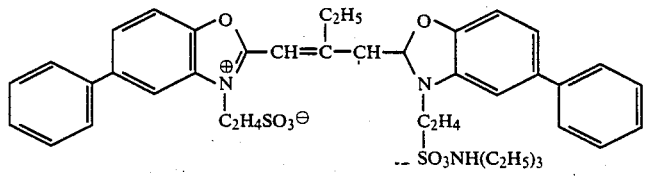

-continued

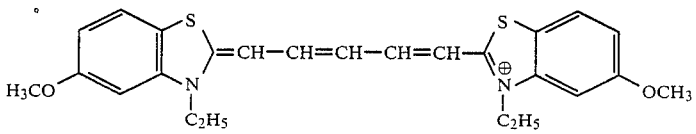

[SD-3]

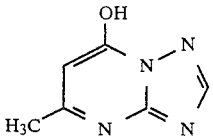

[STB-1]

(Preparation of Samples of Light-Sensitive Silver Halide Color Photographic Materials)

Subsequently, the layers 1 to 7 shown below were provided by coating in succession (simultaneous coating) on paper supports whose both sides were covered with polyethylene to prepare light-sensitive silver halide color photographic materials. (In the following examples, the amounts for addition are each expressed in terms of the amount per 1 $m^2$ of a light-sensitive material.)

Layer 1: A layer containing gelatin (1.2 g), 0.29 g (calculated as silver; the same hereinafter) of blue-sensitive silver halide emulsion (Em-1), and 0.3 g of dinonyl phthalate (DNP) in which 0.75 g of yellow coupler (Y-1), 0.3 g of light stabilizer ST-1 and 0.015 g of 2,5-dioctylhydroquinone (HQ-1) were dissolved.

Layer 2: A layer containing gelatin (0.9 g) and 0.2 g of DOP (dioctyl phthalate) in which 0.04 g of HQ-1 was dissolved.

Layer 3: A layer containing gelatin (1.4 g), 0.2 g of green-sensitive silver halide emulsion (Em-2), 0.5 g of the compound of the present invention or comparative compound, shown in Table 2, in which 0.9 mmol of the magenta coupler shown in Table 2, 0.25 g of light stabilizer ST-2 and 0.01 g of HQ-1 were dissolved, and 6 mg of filter dye AI-1 shown below.

Layer 4: A layer containing gelatin (1.2 g) and 0.3 g of DNP in which 0.6 g of ultraviolet absorbent UV-1 and 0.05 of HQ-1 were dissolved.

Layer 5: A layer containing gelatin (1.4 g), 0.20 g of red-sensitive silver halide emulsion (Em-3), and 0.3 g of DOP in which 0.54 g of cyan coupler (C-1), 0.01 g of HQ-1 and 0.3 g of ST-1 were dissolved.

Layer 6: A layer containing gelatin (1.1 g), 0.2 g of DOP in which 0.2 g of UV-1 was dissolved, and 5 mg of filter dye AI-2 shown below.

Layer 7: A layer containing gelatin (1.0 g) and 0.05 g of sodium 2,4-dichloro-6-hydroxytriazine.

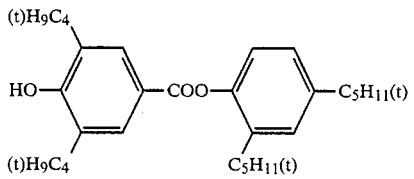

(ST-1)

-continued

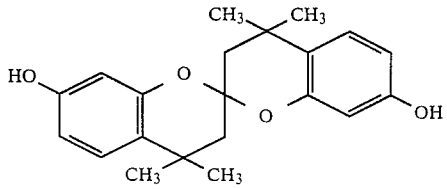

(ST-2)

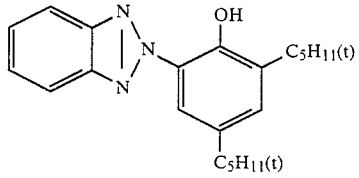

UV-1

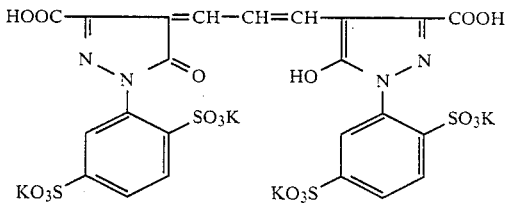

AI-1

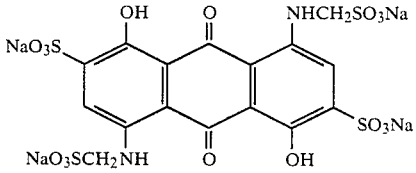

AI-2

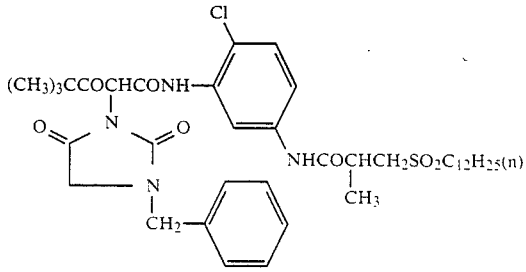

(Y-1)

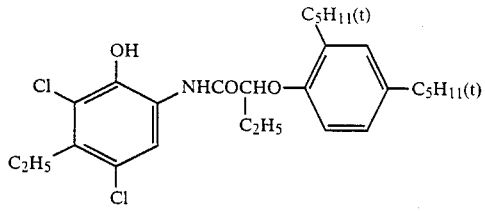

(C-1)

After the samples thus obtained were subjected to wedge exposure with use of sensitometer, KS-7 Type (manufactured by Konishiroku Photo Industry Co., Ltd.), they were processed according to the color development processing steps shown below, and thereafter the maximum density (Dmax) of the green-sensitive silver halide emulsion layers was measured with use of an optical densitometer (PDA-65 Type manufactured by Konishiroku Photo Industry Co., Ltd.).

Also measured were maximum absorption wavelength λmax, and densities at 430 nm and 600 nm, i.e., $D_B$ and $D_R$, at that time.

The samples obtained were also subjected to color-fading tests with use of a fadometer, and retension (%) of a dye image at initial density 1.0 was determined to evaluate the light resistance.

The relative sensitivity was shown as a relative value assuming the sensitivity of Sample No. 1 as 100.

Results obtained are shown in Table 2.

| [Processing steps] | Temperature | Time |
|---|---|---|
| Color developing | 34.7 ± 0.3° C. | 45 seconds |
| Bleach-fixing | 34.7 ± 0.5° C. | 50 seconds |
| Stabilizing | 30 to 34° C. | 90 seconds |
| Drying | 60 to 80° C. | 60 seconds |

-continued

| [Color developing solution] | |
|---|---|
| Pure water | 800 ml |
| Triethanolamine | 8 g |
| N,N-diethylhydroxylamine | 5 g |
| Potassium chloride | 2 g |
| N—ethyl-N—β-methanesulfonamidoethyl-3-methyl-4-aminoaniline sulfate | 5 g |
| Sodium tetrapolyphosphate | 2 g |
| Potassium carbonate | 30 g |
| Potassium sulfite | 0.2 g |
| Brightening agent (a 4,4'-diaminostilbenedisulfonic acid derivative) | 1 g |
| Made up to 1 liter in total amount by adding pure water, and adjusted to pH 10.2. | |
| [Bleach-fixing solution] | |
| Ferric ethylenediaminetetraacetate ammonium dihydrate | 60 g |
| Ethylenediaminetetraacetic acid | 3 g |
| Ammonium thiosulfate (a 70% solution) | 100 ml |
| Ammonium sulfite (a 40% solution) | 27.5 ml |
| Adjusted to pH 5.7 by use of potassium carbonate or glacial acetic acid, and made up to 1 liter in total amount by adding water. | |
| [Stabilizing solution] | |
| 5-Chloro-2-methyl-4-isothiazolin-3-on | 1 g |
| 1-Hydroxyethylidene-1,1-diphosphonic acid | 2 g |
| Made up to 1 liter by adding water, and adjusted to pH by use of sulfuric acid or potassium hydroxide. | 7.0 |

TABLE 2

| Sample No. | Magenta coupler | Compound(1) | Maximum density Dmax | Relative sensitivity | λmax(2) (nm) | $D_B$ | $D_R$ | Light resistance (%) | (3) |
|---|---|---|---|---|---|---|---|---|---|
| 1 | MM-1 | DNP* | 2.61 | 100 | 541 | 0.40 | 0.38 | 88 | X |
| 2 | 10 | DNP* | 2.42 | 91 | 549 | 0.20 | 0.43 | 76 | X |
| 3 | 12 | DNP* | 2.45 | 92 | 550 | 0.20 | 0.44 | 79 | X |
| 4 | 23 | DNP* | 2.43 | 91 | 549 | 0.21 | 0.44 | 84 | X |
| 5 | 46 | DNP* | 2.44 | 93 | 551 | 0.21 | 0.45 | 74 | X |
| 6 | 61 | DNP* | 2.37 | 89 | 551 | 0.20 | 0.44 | 82 | X |
| 7 | 64 | DNP* | 2.33 | 87 | 552 | 0.21 | 0.46 | 81 | X |
| 8 | 10 | TCP** | 2.46 | 93 | 548 | 0.20 | 0.40 | 79 | X |
| 9 | MM-1 | I-69 | 2.69 | 105 | 537 | 0.42 | 0.35 | 91 | X |
| 10 | 10 | I-69 | 2.61 | 104 | 544 | 0.18 | 0.33 | 89 | Y |
| 11 | 12 | I-69 | 2.62 | 105 | 545 | 0.19 | 0.33 | 88 | Y |
| 12 | 23 | I-69 | 2.60 | 103 | 544 | 0.19 | 0.33 | 92 | Y |
| 13 | 46 | I-69 | 2.58 | 102 | 546 | 0.18 | 0.34 | 86 | Y |
| 14 | 61 | I-69 | 2.55 | 99 | 545 | 0.19 | 0.33 | 90 | Y |
| 15 | 64 | I-69 | 2.53 | 98 | 546 | 0.19 | 0.35 | 91 | Y |
| 16 | 23 | I-3 | 2.61 | 104 | 545 | 0.18 | 0.34 | 90 | Y |
| 17 | 23 | I-4 | 2.58 | 103 | 544 | 0.18 | 0.33 | 90 | Y |
| 18 | 23 | I-34 | 2.62 | 106 | 545 | 0.19 | 0.34 | 91 | Y |
| 19 | 23 | I-44 | 2.64 | 107 | 546 | 0.18 | 0.35 | 90 | Y |
| 20 | 23 | I-46 | 2.67 | 110 | 546 | 0.18 | 0.35 | 89 | Y |
| 21 | 23 | I-60 | 2.63 | 106 | 545 | 0.19 | 0.33 | 92 | Y |
| 22 | 23 | I-67 | 2.59 | 103 | 545 | 0.18 | 0.33 | 92 | Y |
| 23 | 23 | I-71 | 2.56 | 101 | 544 | 0.18 | 0.32 | 93 | Y |
| 24 | 50 | I-4 | 2.54 | 98 | 546 | 0.18 | 0.35 | 90 | Y |
| 25 | 50 | I-34 | 2.57 | 98 | 547 | 0.17 | 0.36 | 90 | Y |
| 26 | 50 | I-44 | 2.61 | 101 | 547 | 0.19 | 0.37 | 88 | Y |
| 27 | 50 | I-46 | 2.62 | 103 | 547 | 0.18 | 0.36 | 89 | Y |
| 28 | 50 | I-60 | 2.56 | 99 | 546 | 0.19 | 0.35 | 91 | Y |
| 29 | 50 | I-67 | 2.54 | 97 | 546 | 0.19 | 0.35 | 90 | Y |
| 30 | 63 | I-4 | 2.51 | 96 | 546 | 0.19 | 0.35 | 92 | Y |
| 31 | 63 | I-34 | 2.53 | 98 | 547 | 0.20 | 0.36 | 91 | Y |
| 32 | 63 | I-44 | 2.57 | 100 | 547 | 0.20 | 0.35 | 90 | Y |
| 33 | 63 | I-46 | 2.57 | 101 | 547 | 0.19 | 0.35 | 91 | Y |
| 34 | 63 | I-60 | 2.54 | 99 | 546 | 0.19 | 0.36 | 90 | Y |
| 35 | 63 | I-67 | 2.51 | 98 | 545 | 0.20 | 0.34 | 92 | Y |
| 36 | 64 | I-4 | 2.52 | 97 | 546 | 0.19 | 0.34 | 90 | Y |
| 37 | 64 | I-34 | 2.53 | 99 | 546 | 0.19 | 0.35 | 89 | Y |
| 38 | 64 | I-44 | 2.58 | 102 | 547 | 0.20 | 0.37 | 89 | Y |
| 39 | 64 | I-46 | 2.56 | 101 | 546 | 0.19 | 0.36 | 90 | Y |
| 40 | 64 | I-60 | 2.54 | 99 | 546 | 0.19 | 0.35 | 91 | Y |
| 41 | 64 | I-67 | 2.52 | 97 | 546 | 0.20 | 0.35 | 92 | Y |
| 42 | 10 | I-4 | 2.63 | 107 | 544 | 0.17 | 0.33 | 90 | Y |

TABLE 2-continued

| Sample No. | Magenta coupler | Compound(1) | Maximum density Dmax | Relative sensitivity | λmax(2) (nm) | $D_B$ | $D_R$ | Light resistance (%) | (3) |
|---|---|---|---|---|---|---|---|---|---|
| 43 | 10 | I-46 | 2.66 | 111 | 545 | 0.18 | 0.34 | 88 | Y |

(1)Compound of the invent1on or comparative compound
(2)Maximum absorption wavelength
(3)Remarks
*Dinonyl phthalate
**Tricresyl phosphate
X: Comparative Example
Y: Present invention Comparative magenta coupler (MM-1)

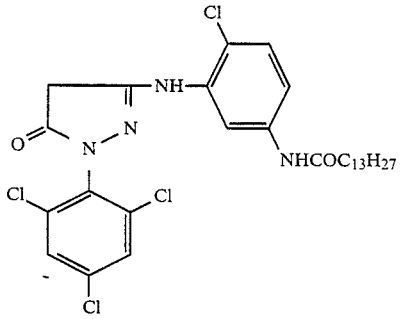

As will be clear from the results shown in Table 2, the pyrazoloazole type magenta couplers of the present invention show a very small secondary absorption ($D_B$) at the shorter wavelength side of the dye image obtained by the color development, as compared with the conventionally used 5-pyrazolone type comparative coupler (MM-1), but have the disadvantages such that the maximum absorption wavelength is a little longer wavelength and the absorption ($D_R$) at the longer wavelength side is a little large. Also, the color-forming properties and the light resistance represented by the relative sensitivity and the maximum density, respectively, can not be said to be satisfactory (see Samples No. 2 to No. 8).

In contrast thereto, Samples No. 10 to No. 43 in which the pyrazoloazole type magenta coupler of the present invention and the compound of the present invention are used in combination, retain the characteristic feature inherent in pyrazoloazole type magenta couplers, that all of them show a small $D_B$, and at the same time there can be obtained sufficiently high maximum densities and sensitivities. Moreover, the maximum absorption wavelengths are as ideal as 544 nm to 547 nm and also $D_R$ is small. Thus, they are seen to have superior color reproducibility and also have superior light resistance.

EXAMPLE 2

Example 1 was repeated to prepare light-sensitive silver halide color photographic materials Nos. 44 to 77, except that the blue-sensitive silver halide emulsion in Layer 1 of the light-sensitive silver halide color photographic materials prepared in Example 1 was replaced with Em-4 shown in Table 1, the green-sensitive silver halide emulsion in Layer 3 with Em-5 shown in Table 1, and the red-sensitive silver halide emulsion in Layer 5 with Em-6 shown in Table 1, respectively, and also that the magenta coupler and the compound of the present invention or comparative compound as shown in Table 3 was used in Layer 3.

After the samples thus obtained were subjected to wedge exposure with use of a sensitometer KS-7 Type (manufactured by Konishiroku Photo Industry Co., Ltd.), they were processed according to the color development processing steps shown below, and thereafter the measurement was carried out in the same manner as in Example 1.

Results obtained are shown in Table 3.

| [Processing steps] | | |
|---|---|---|
| Color developing | 3 min 30 sec | Temp: 33° C. |
| Bleach-fixing | 1 min 30 sec | Temp: 33° C. |
| Washing | 3 min | Temp: 33° C. |

| | |
|---|---|
| Formulation of color developing solution: | |
| N-ethyl-N-β-methanesulfonamidoethyl-3-methyl-4-aminoaniline sulfate | 4.9 g |
| Hydroxylamine sulfate | 2.0 g |
| Potassium carbonate | 25.0 g |
| Sodium bromide | 0.6 g |
| Anhydrous sodium sulfite | 2.0 g |
| Benzyl alcohol | 13 ml |
| Polyethylene glycol (average polymerization degree: 400) | 3.0 ml |
| Made up to 1 liter by adding water, and adjusted to pH 10.0 with use of sodium hydroxide. | |
| Formulation of bleach-fixing solution: | |
| Ferric ethylenediaminetetraacetate sodium salt | 6.0 g |
| Ammonium thiosulfate | 100 g |
| Sodium bisulfite | 10 g |
| Sodium metabisulfite | 3 g |
| Made up to 1 liter by adding water, and adjusted to pH with use of ammonia water. | 7.0 |

TABLE 3

| Sample No. | Magenta coupler | Compound(1) | Maximum density Dmax | Relative sensitivity | λmax(2) (nm) | $D_B$ | $D_R$ | Light resistance (%) | (3) |
|---|---|---|---|---|---|---|---|---|---|
| 44 | MM-1 | DNP | 2.66 | 100 | 540 | 0.41 | 0.39 | 89 | X |
| 45 | 10 | DNP | 2.48 | 90 | 549 | 0.22 | 0.44 | 77 | X |
| 46 | 12 | DNP | 2.51 | 92 | 550 | 0.22 | 0.46 | 78 | X |
| 47 | 23 | DNP | 2.46 | 88 | 549 | 0.22 | 0.45 | 83 | X |
| 48 | 46 | DNP | 2.52 | 93 | 551 | 0.21 | 0.46 | 72 | X |
| 49 | 61 | DNP | 2.40 | 85 | 550 | 0.23 | 0.45 | 81 | X |
| 50 | 64 | DNP | 2.37 | 84 | 552 | 0.22 | 0.47 | 82 | X |

TABLE 3-continued

| Sample No. | Magenta coupler | Compound[1] | Maximum density Dmax | Relative sensitivity | λmax[2] (nm) | $D_B$ | $D_R$ | Light resistance (%) | [3] |
|---|---|---|---|---|---|---|---|---|---|
| 51 | 10 | TCP | 2.54 | 93 | 548 | 0.22 | 0.41 | 78 | X |
| 52 | MM-1 | I-69 | 2.75 | 106 | 537 | 0.40 | 0.36 | 90 | X |
| 53 | 10 | I-69 | 2.67 | 106 | 544 | 0.19 | 0.35 | 89 | Y |
| 54 | 12 | I-69 | 2.68 | 106 | 545 | 0.20 | 0.36 | 89 | Y |
| 55 | 23 | I-69 | 2.65 | 105 | 545 | 0.19 | 0.35 | 90 | Y |
| 56 | 46 | I-69 | 2.71 | 110 | 546 | 0.19 | 0.36 | 85 | Y |
| 57 | 61 | I-69 | 2.61 | 100 | 545 | 0.20 | 0.35 | 90 | Y |
| 58 | 64 | I-69 | 2.58 | 98 | 547 | 0.21 | 0.38 | 91 | Y |
| 59 | 10 | 1-5 | 2.68 | 106 | 543 | 0.19 | 0.34 | 88 | Y |
| 60 | 10 | 1-15 | 2.66 | 105 | 544 | 0.19 | 0.35 | 89 | Y |
| 61 | 10 | 1-23 | 2.67 | 106 | 544 | 0.19 | 0.35 | 88 | Y |
| 62 | 10 | 1-25 | 2.65 | 104 | 545 | 0.20 | 0.36 | 88 | Y |
| 63 | 10 | 1-47 | 2.71 | 109 | 544 | 0.20 | 0.35 | 87 | Y |
| 64 | 10 | 1-53 | 2.70 | 108 | 545 | 0.19 | 0.35 | 89 | Y |
| 65 | 10 | 1-58 | 2.65 | 104 | 544 | 0.19 | 0.34 | 89 | Y |
| 66 | 10 | 1-87 | 2.69 | 107 | 545 | 0.20 | 0.35 | 88 | Y |
| 67 | 10 | 1-88 | 2.67 | 106 | 545 | 0.20 | 0.36 | 89 | Y |
| 68 | 10 | 1-94 | 2.66 | 105 | 545 | 0.20 | 0.35 | 87 | Y |
| 69 | 10 | 1-95 | 2.64 | 105 | 544 | 0.19 | 0.35 | 90 | Y |
| 70 | 7 | 1-69 | 2.58 | 99 | 547 | 0.21 | 0.38 | 86 | Y |
| 71 | 14 | 1-69 | 2.70 | 111 | 545 | 0.20 | 0.36 | 88 | Y |
| 72 | 22 | 1-69 | 2.64 | 102 | 545 | 0.19 | 0.35 | 91 | Y |
| 73 | 26 | 1-69 | 2.69 | 106 | 546 | 0.20 | 0.37 | 91 | Y |
| 74 | 30 | 1-69 | 2.67 | 105 | 546 | 0.21 | 0.38 | 90 | Y |
| 75 | 33 | 1-69 | 2.68 | 107 | 545 | 0.20 | 0.37 | 91 | Y |
| 76 | 40 | 1-69 | 2.62 | 100 | 545 | 0.20 | 0.36 | 91 | Y |
| 77 | 47 | 1-69 | 2.65 | 104 | 545 | 0.20 | 0.36 | 88 | Y |

[1]Compound of the invention or comparative compound
[2]Maximum absorption wavelength
[3]Remarks
X: Comparative Example
Y: Present invention As will be clear from the results shown in Table 3, it is understood that, also in the present Example, the samples of the present invention show appropriate maximum absorption wavelength, both small $D_B$ and $D_R$, and superior color reproducibility, there can be obtained sufficiently high maximum densities and sensitivities, and also the light resistance has been improved.

Incidentally, in the present Example, used as a color developing solution was a developing solution containing benzyl alcohol as a color development accelerator conventionally used in many instances.

The results of the present Example tell that the present invention also exhibits sufficient effect in such a system.

EXAMPLE 3

Samples No. 79 and No. 79 were prepared in the same manner as in Samples Nos. 10 and 12 except that the DNP in each first layer of Samples Nos. 10 and 12 in Example 1 was replaced by compound I-69. Further provided for use were Samples Nos. 1, 2, 4, 9, 10 and 12 prepared in Example 1.

These samples were exposed and subjected to color development processing in the same manner as in Example 1, and thereafter evaluation of color reproducibility was made according to the following procedures.

First, photographs of a color checker available from Macbeth Co. were taken with use of a color negative film (Konicolor; available from Konica Corporation) and a camera (Konica FT-1 MOTOR; available from Konica Corporation). Subsequently, color negative development processing (using CNK-4; available from Konica negative images were printed with use of a color printer CL-P2000 (available from Konica Corporation) on the above Samples Nos. 1 to 6 with the size of 82 mm×117 mm, followed by processing in the same manner as in Example 1 described above to obtain actual prints. Printer conditions at the time of the printing was set for each sample so that the gray colors on the color checker may be in gray colors on the prints.

On the resulting actual prints, color reproducibility was evaluated. Results obtained are shown together in Table 4.

It is seen from Table 4 that the color reproducibility can be further enhanced when the yellow coupler represented by Formula (Y-I) and the compound represented by Formula (I) described previously are used (Samples 78 and 79).

TABLE 4

| Sample No. | Magenta coupler | Compound contained in magenta coupler layer | Compound contained in yellow coupler layer | Color reproducibility | | | | | | |
|---|---|---|---|---|---|---|---|---|---|---|
| | | | | Blue | Green | Red | Yellow | Magenta | Cyan | Remarks |
| 1 | MM-1 | DNP | DNP | B | B | B | B | B | B | X |
| 2 | 10 | DNP | DNP | B | B | A | B | A | B | X |
| 4 | 23 | DNP | DNP | B | B | A | B | A | B | X |
| 9 | MM-1 | I-69 | DNP | B | B | B | B | B | B | X |
| 10 | 10 | I-69 | DNP | A | B | AA | B | AA | A | Y |
| 12 | 23 | I-67 | DNP | A | B | AA | B | AA | A | Y |

TABLE 4-continued

| Sample No. | Magenta coupler | Compound contained in magenta coupler layer | Compound contained in yellow coupler layer | Color reproducibility | | | | | | |
|---|---|---|---|---|---|---|---|---|---|---|
| | | | | Blue | Green | Red | Yellow | Magenta | Cyan | Remarks |
| 78 | 10 | I-69 | I-69 | A | A | AA | A | AA | A | Y |
| 79 | 23 | I-69 | I-69 | A | A | AA | A | AA | A | Y |

AA: Very good color reproducibility
A: Good color reproducibility
B: Poor color reproducibility (hue and chroma)
X: Comparative Example
Y: Present invention

EXAMPLE-4

Using an exposure apparatus "Konica Konsensus B-2" (Manufactured by Konica Corporation) which comprises, as shown in FIG. 1, a light source 1, an exposure table 2, filter 3, lens 4 and a shutter 5, color proof images were prepared in the following manner using sample light-sensitive paper materials which were prepared in the same manner as in Example 1 of the present invention except that the magenta coupler and/or yellow coupler and the compound were used in the blue-sensitive and green-sensitive layers as given in Table 5:

A sample light-sensitive paper material was set on the paper tray 6 of the exposure apparatus.

Apart from this, a yellow color separation negative film was set on the exposure table 5 at the register pins, which have been provided on the exposure table 5 in order to ensure accurate positioning of respective four color separation negative films, and printing on the light-sensitive paper was carried out through a blue filter. Then, the yellow color separation negative film was replaced by a magenta color separation negative film and printing on the light-sensitive paper was effected through a green filter. In a similar manner printing operations from a cyan color separation negative film through a red filter and from a black color separation negative film through the blue, green and red filters, respectively, at the proper exposure ratio which was applied in the printing operations with the yellow, magenta and cyan color separation negative films.

Then, thus exposed sample light-sensitive paper was processed in the same manner as in Example 1, to obtain a sample color proof image.

In this Example, as filters Kodak Wratten Filters 47B (blue), 58 (green) and 29 (red) were used.

The proper amount of exposure for the black color separation negative films was determined by exposing the light-sensitive paper using an original with 0% halftone dot through respective filters and developed so that the reflection densities of thus obtained yellow, magenta and cyan dye images became 1.7 to 1.8, respectively.

It was apparent by visual observation that color proof images obtained by the use of light-sensitive papers of the present invention, had better color reproduction of the actual printed image, which includes magenta, yellow and red colors, and are obtained from the same color separation negative films, as compared with those obtained by the use of comparative samples. Further, it is apparent from the results given in Table 5, that the samples of the present invention have better color reproduction properties than the comparative samples with respect to magenta, yellow and, therefore, red colors, when the reproduced color is expressed in terms of the L*a*b* chromaticity diagram, wherein the closer the numerical values of L*, a* and b* are to those of the actual printed image, the better is the color reproduction ability.

The values of L*, a* and b* in this Example were obtained using Spectro Photometric Colorimeter CMS-1200 (a product of MURAKAMI Color Research Laboratory).

TABLE 5

| Sample No. | Printed Material/or Magenta/Yellow-Dye Forming Coupler Used | Compound Contained in Blue or Green Sensitive Layer | L* | a* | b* |
|---|---|---|---|---|---|
| 1 | Printed Material (Magenta) | | 47.99 | 62.27 | 0.79 |
| 2 | 10 | TCP | 45.70 | 64.37 | −19.01 |
| 3 | 10 | I-69 | 46.44 | 54.20 | −5.29 |
| 4 | 23 | I-44 | 46.87 | 53.64 | −5.57 |
| 5 | 10 | I-4 | 46.68 | 54.43 | −5.51 |
| 6 | 10 | I-5 | 46.47 | 54.80 | −5.36 |
| 7 | Printed Material (Yellow) | | 86.23 | −12.38 | 87.01 |
| 8 | Y-44 | TCP | 78.37 | 2.56 | 75.81 |
| 9 | Y-44 | I-69 | 81.46 | −7.81 | 80.75 |
| 10 | Y-64 | I-69 | 83.73 | −10.36 | 83.89 |
| 11 | Y-59 | I-69 | 82.54 | −8.86 | 81.38 |
| 12 | Y-66 | I-69 | 82.36 | −9.41 | 83.51 |

Figure 1:
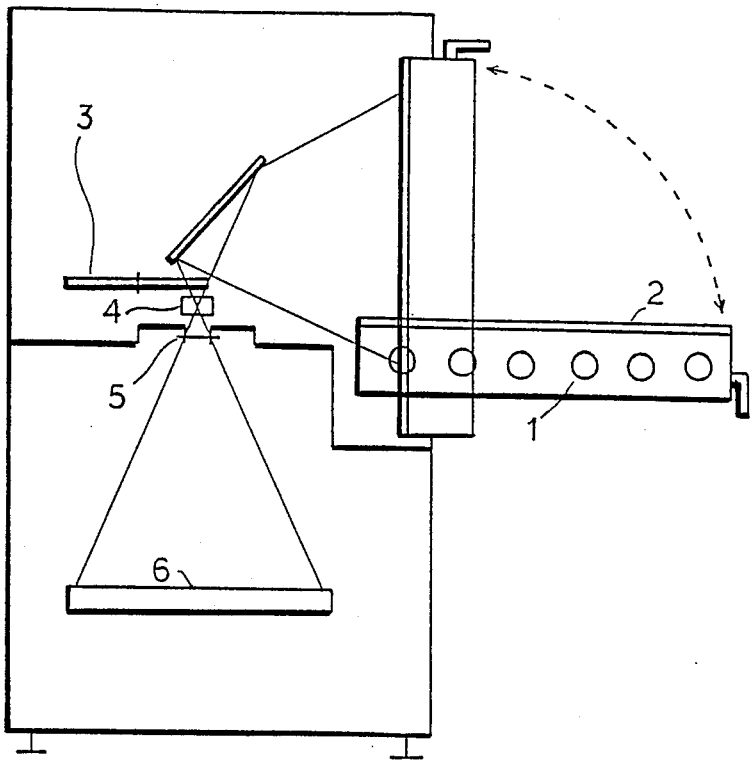
FIG. 1 shows a schematic structure of the exposure apparatus for preparing proof images in Example 4, wherein numerical symbol represents as follows.

1: Light source
2: Exposure table
3: Filter
4: Lens
5: Shutter
6: Paper tray

What is claimed is:

1. A light-sensitive silver halide photographic material comprising a support and provided thereon a silver halide emulsion layer containing a magenta dye-forming coupler represented by formula (M-I) and a compound represented by formula (I);

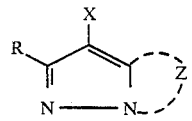

(M-1)

wherein Z represents a group of non-metal atoms necessary to complete a nitrogen-containing heterocyclic ring which may have a substituent; X represents a hydrogen atom or a substituent capable of being split off upon reaction with the oxidized product of a color developing agent; and R represents a hydrogen atom or a substituent;

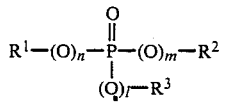

(I)

wherein $R^1$, $R^2$ and $R^3$ independently represent an aliphatic group or an aromatic group; and l, m, n independently represent 0 or 1 provided that l, m and n are not 1 at the same time.

2. The light-sensitive silver halide photographic material of claim 1, wherein R is (M-I) is an alkyl group having 1 to 32 carbon atoms.

3. The light-sensitive silver halide photographic material of claim 1, wherein X in (M-I) is a halogen atom.

4. The light-sensitive silver halide photographic material of claim 1, wherein the magenta dye-forming coupler of (M-I) is selected from those represented by formulas (M-II), (M-III), (M-IV), (M-V), (M-VI) and (M-VII);

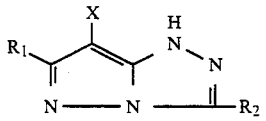

(M-II)

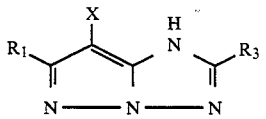

(M-III)

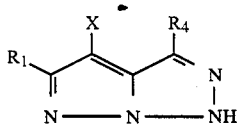

(M-IV)

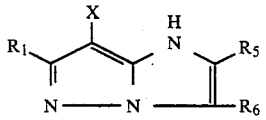

(M-V)

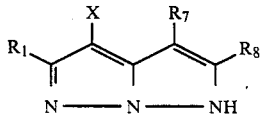

(M-VI)

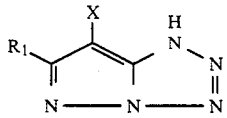

(M-VII)

wherein, $R_1$ through $R_8$ and X in formulas (M-II), (M-III), (M-IV), (M-V), (M-VI) and (M-VII) have the same definitions as for R and X, respectively.

5. The light-sensitive silver halide photographic material of claim 1, wherein the magenta dye-forming coupler of (M-I) is selected from those represented by formula (M-VIII);

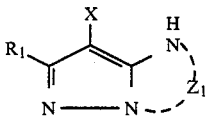

wherein $Z_1$ represents a group of non-metal atoms necessary to complete a nitrogen-containing heterocyclic ring which may have a substituent; X represents a hydrogen atom or a substituent capable of being split off upon reaction with the oxidized product of a color developing agent; and $R_1$ represents a hydrogen atom or a substituent.

6. The light-sensitive silver halide photographic material of claim 1, wherein $R^1$, $R^2$ and $R^3$ of the compound (I) are respectively alkyl groups provided that the total number of carbon atoms is 6 to 50.

7. The light-sensitive silver halide photographic material of claim 1, wherein R in formula (M-I) is a group represented by formula (M-IX);

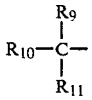

(M-IX)

wherein $R_9$, $R_{10}$ and $R_{11}$ independently represent a hydrogen atom or a substituent.

8. The light-sensitive silver halide photographic material of claim 4, wherein $R_1$ in formulas (M-II) through (M-VII) is a group represented by formula (M-IX);

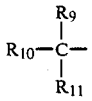

(M-IX)

wherein $R_9$, $R_{10}$ and $R_{11}$ independently represent a hydrogen atom or a substituent.

9. The light-sensitive silver halide photographic material of claim 5, wherein $R_1$ in formula (M-VIII) is a group represented by formula (M-IX);

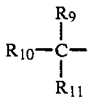

(M-IX)

wherein $R_9$, $R_{10}$ and $R_{11}$ independently represent a hydrogen atom or a substituent.

10. The light-sensitive silver halide photographic material of claim 1, wherein the amount of magenta dye forming coupler added is $1\times10^{-3}$ to 1 mole per mole of silver halide.

11. The light-sensitive silver halide photographic material of claim 10, wherein the amount of magenta dye forming coupler added is $1\times10^{-2}$ to $8\times10^{-1}$ mole per mole of silver halide.

12. The light-sensitive silver halide photographic material of claim 1, wherein the amount of compound of formula (I) added is 5 to 500 mol% per said magenta dye-forming coupler of (M-I).

13. The light-sensitive silver halide photographic material of claim 12, wherein the amount of compound of formula (I) added is 10 to 300 mol% per said magenta dye-forming coupler of (M-I).

14. The light-sensitive silver halide photographic material of claim 1, wherein said material further comprises a silver halide emulsion layer containing a yellow dye-forming coupler represented by formula (Y-I) and the compound represented by formula (I);

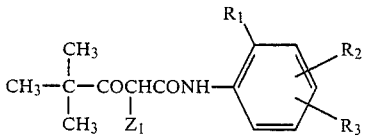

(Y-I)

wherein $R_1$ is a halogen atom or an alkoxy group, $R_2$ is a hydrogen atom or a substituent which is substitutable to a benzen ring, $R_3$ is an organic group, and $Z_1$ is a hydrogen atom or a substituent capable of being split off upon reaction with the oxidized product of a color developing agent.

* * * * *